United States Patent [19]

Davila et al.

[11] 4,407,312

[45] Oct. 4, 1983

[54] FARE COLLECTION SYSTEM AND COMPONENTS THEREOF

[75] Inventors: Jose E. Davila, Bourbonnais; Jim H. Gomez, Kankakee, both of Ill.

[73] Assignee: General Railway Signal Company, Stamford, Conn.

[21] Appl. No.: 153,912

[22] Filed: May 28, 1980

[51] Int. Cl.[3] ..... G07D 9/04

[52] U.S. Cl. ..... 133/8 R; 194/102

[58] Field of Search ..... 133/3 R, 3 E, 3 G, 3 H, 133/8 R; 194/102

[56] References Cited

U.S. PATENT DOCUMENTS

| | | | |
|---|---|---|---|
| 420,265 | 1/1890 | Bricker . | |
| 1,032,876 | 7/1912 | Bucknam . | |
| 1,749,421 | 3/1930 | Donnellan | 133/3 E |
| 1,947,456 | 2/1934 | Bock | 133/3 G |
| 2,079,255 | 5/1937 | Jones . | |
| 3,699,981 | 10/1972 | Conant et al. | 133/8 R |
| 3,843,203 | 10/1974 | Golland et al. . | |

*Primary Examiner*—F. J. Bartuska

*Attorney, Agent, or Firm*—Emrich & Lee and Brown, Hill, Dithmar, Stotland, Stratman & Levy

[57] ABSTRACT

A fare collection system including a fare box having a coin singulating and counting device in the upper portion thereof and paper receiving means in the upper portion thereof, a secure cash box in the pedestal of the fare box for receiving the coins and paper and having lock mechanism for locking the cash box in the pedestal so long as the cash box is open and a cover for closing the cash box prior to removal thereof from the pedestal; a master vault having an upper compartment for receiving the cash box in the inverted position and lock mechanism for locking the cash box in the upper compartment during the emptying thereof, a lower compartment for the master vault having a cash container removably positioned therein, aligned openings in the upper and lower compartments communicating with an opening in the top of the cash container, a closure member for the cash container, and lock mechanism for holding the cash container in the lower compartment when the closure member is open and for locking the closure member in the closed position for removal of the cash container from the master vault.

19 Claims, 26 Drawing Figures

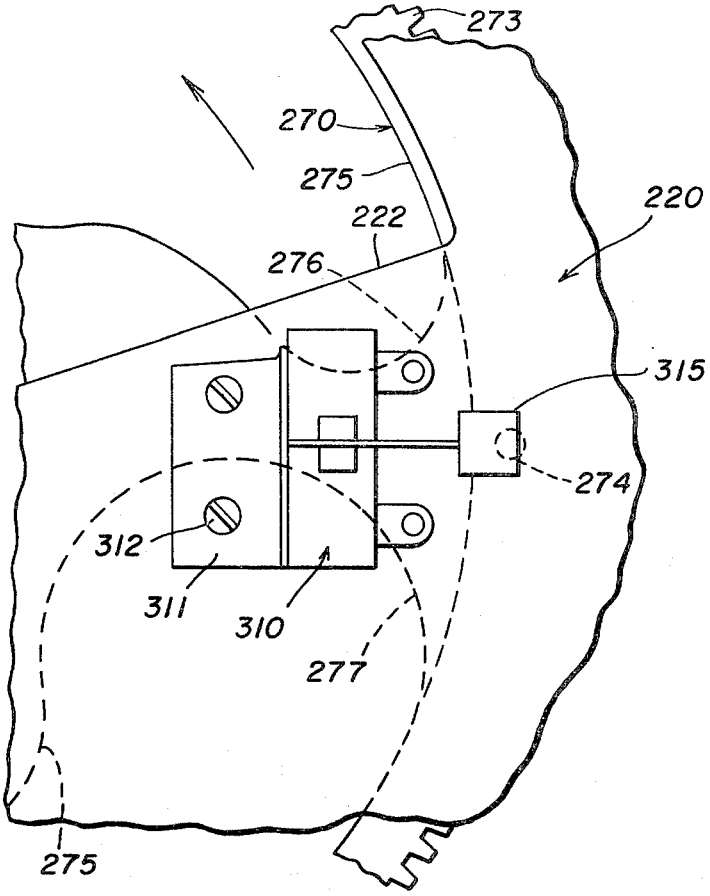
FIG. 13
FIG. 14
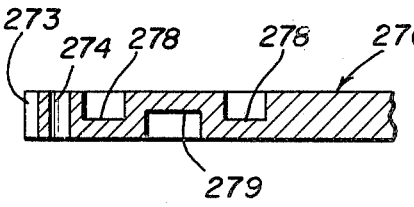
FIG. 15
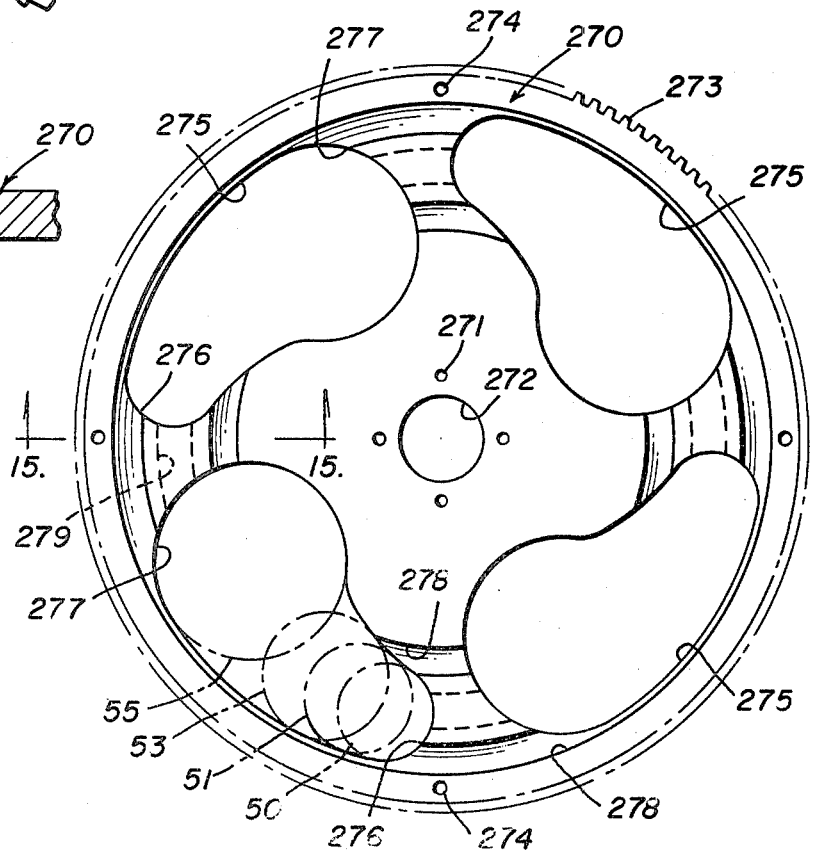

FARE COLLECTION SYSTEM AND COMPONENTS THEREOF

PRIOR ART STATEMENT AND BACKGROUND OF THE INVENTION

The present invention relates generally to improvements in fare collection systems and components thereof, and specifically to the provision of an improved fare box having a coin singulating and counting device therein and a cash box adapted to cooperate with a master vault for security purposes.

This invention is an improvement upon the fare collection system and components thereof described and claimed in our copending patent application Ser. No. 855,970 filed Nov. 30, 1977, now U.S. Pat. No. 4,210,801.

In one form of the standard fare collection system used heretofore, a fare box was provided for each individual vehicle such as a bus, the fare box counting and recording the coins as deposited; at the end of a work shift, the vehicle was taken to a central location where the contents of the fare box are removed by pneumatic means to a central secure vault. An example of such a system is illustrated in U.S. Pat. No. 3,843,203 granted Oct. 22, 1974 to Golland et al. The fare box of such a system is mechanically complicated and expensive to manufacture, the complicated fare box frequently jamming and presenting severe service problems during use. Although the pneumatic withdrawal of the contents of the fare box is supposedly under secure conditions, practice has shown that the measures taken are not sufficient absolutely to prevent unauthorized withdrawal of fares from the fare box. Specifically, the system is not secure against forcible entry, and forcible entry may take place without any warning to management that such forcible entry has occurred.

Prior fare boxes are illustrated in U.S. Pat. No. 420,265 granted Jan. 28, 1890 to Bricker, U.S. Pat. No. 1,032,876 granted July 16, 1912 to Bucknam and U.S. Pat. No. 2,079,255 granted May 4, 1937 to Jones. None of these prior fare boxes provide the security of the fare box in the present invention.

BRIEF SUMMARY OF THE INVENTION

The present invention provides an improved fare collection system and components thereof which can rapidly process the collection and storage of fares on a vehicle, such as a bus, with counting and recording of the coins, together with safekeeping of the contents of the fare box followed by secure removal of the contents to a central vault.

This is accomplished in the present invention, and it is an object of the present invention to accomplish these desired results, by providing a fare collection system including a fare box having a coin singulating and counting device therein that receives coins and after the counting thereof deposits the same in a secure cash box in the pedestal of the fare box, which cash box can then be removed with security to a secure central vault.

Another object of the invention is to provide in such a fare collection system a coin singulating and counting device including a mounting plate, a coin sizing disk overlying the mounting plate and mounted for rotation with respect thereto, a transfer plate overlying the sizing disk and fixedly mounted with respect to the mounting plate, a coin singulator disk overlying the transfer plate and mounted for rotation with the sizing disk and with respect to the mounting plate and the transfer plate, means for rotating the singulator disk and the sizing disk with respect to the mounting plate and the transfer plate about an axis inclined to the horizontal, the coin singulator disk having at least one open bottom coin singulating pocket therein for receiving coins one at a time from a supply thereof to travel along a first predetermined path on the upper surface of the transfer plate, the transfer plate having an opening therein along the first path and shaped to receive a coin therethrough off the transfer plate and out of the singulating pocket at a predetermined point along the first path, the coin sizing disk having at least one open bottom coin sizing pocket therein for receiving coins one at a time from the singulating pocket to the opening in the transfer plate to travel along a second predetermined path on the upper surface of the mounting plate, the sizing pocket being of increasing size in the direction of travel and shaped and arranged to receive a coin at a predetermined position therein in accordance with the size of the coin, the mounting plate having a coin exit opening therein along the second path and shaped to receive a coin therethrough off the mounting plate and out of the sizing pocket at a predetermined point along the second path, and mechanism for measuring the distance along the second path between a predetermined point on the sizing disk and the exit end of a coin at the coin exit opening for detecting the size of the coin and for counting the coin as the coin passes into the coin exit opening.

Yet another object of the invention is to provide a coin singulating and counting device of the type set forth wherein the mounting plate has a coin discharge ramp leading into the coin exit opening to receive a coin therealong, a coin ejector adjacent to the exit end of the coin discharge ramp to assure that a coin arriving at the coin exit opening exits therethrough off the coin discharge ramp, and mechanism for measuring the distance between a predetermined point along the second path and the exit end of a coin at the exit end of a coin discharge ramp for detecting the size of the coin and for counting the coin as the coin passes from the coin discharge ramp into the coin exit opening.

Still another object of the present invention is to provide a coin singulating and counting device of the type set forth wherein timing indicia are associated with the sizing pocket and indicia sensing means is mounted adjacent to the sizing disk for detecting the passage of the timing indicia thereby, a detector for detecting the leading edge of a coin at a predetermined point along the second path, and timing mechanism initiated by the sensing of the timing indicia and terminated by the actuation of the detector for measuring the distance between a predetermined point along the second path and the exit end of a coin at the coin exit opening for detecting the size of the coin and for counting the coin as the coin passes into the coin exit opening.

Yet another object of the invention is to provide a coin singulating and counting device of the type set forth wherein the detector for detecting the leading edge of a coin is at the exit end of the coin discharge ramp, and the timing mechanism measures the distance between a predetermined point along the second path and the exit end of the coin at the exit end of the coin discharge ramp for detecting the size of the coin and for counting the coin as the coin passes from the exit ramp into the coin exit opening.

Further features of the invention pertain to the particular arrangement of the parts of the fare collection system and the components thereof, whereby the above outlined and additional operating features thereof are attained.

The invention, both as to its organization and method of operation, together with further features and advantages thereof will best be understood with reference to the following specification taken in connection with the accompanying drawings.

BRIEF DESCRIPTION OF THE DRAWINGS

FIG. 13 is an enlarged view showing the underside of a portion of the coin singulating and counting device and showing the timing sensor thereon;

FIG. 14 is a diagrammatic view of the coin sizing plate illustrating the manner in which the coin sizing plate serves to assist in detecting the coin carried in each of the sizing pockets thereof;

FIG. 15 is an enlarged view in section along the line 15—15 of FIG. 14;

DETAILED DESCRIPTION OF THE PREFERRED EMBODIMENTS

Figure 1:
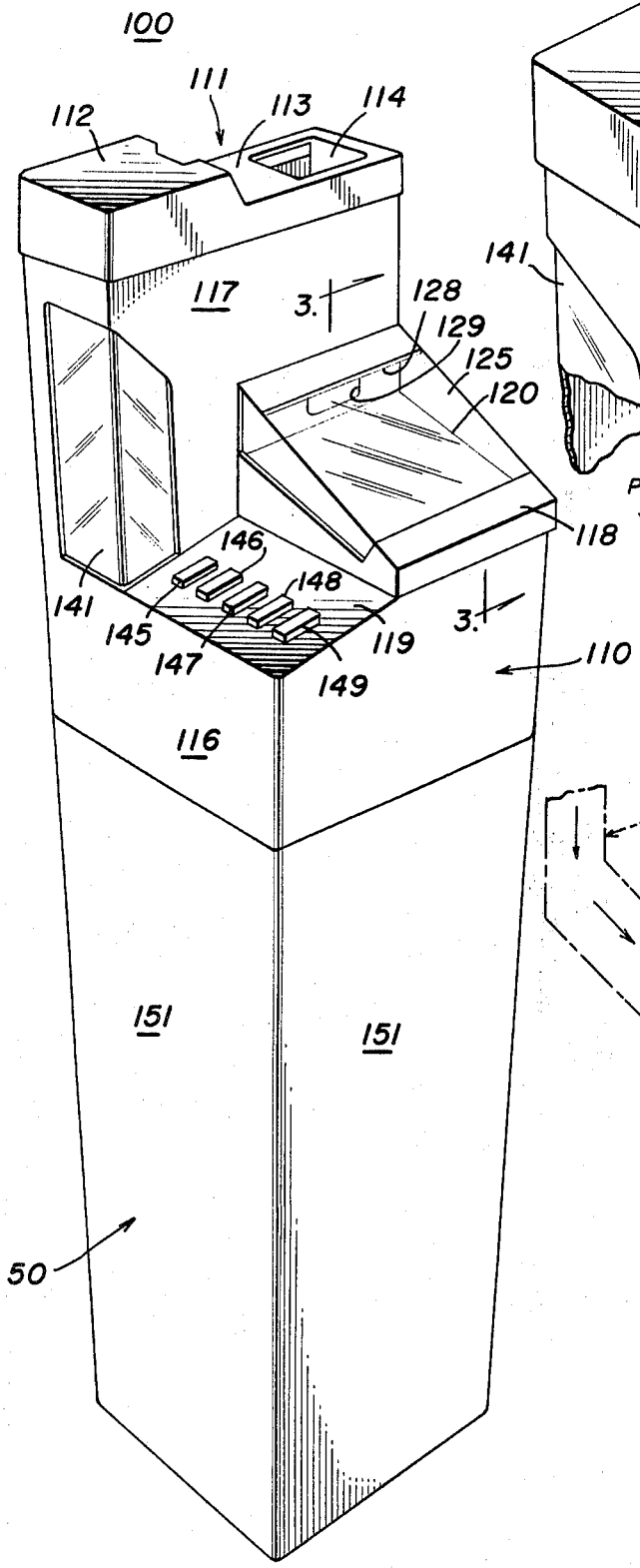
FIG. 1 is a perspective view of a fare box made in accordance with and embodying the principles of the present invention and forming a part of the fare collection system thereof.
Figure 2:
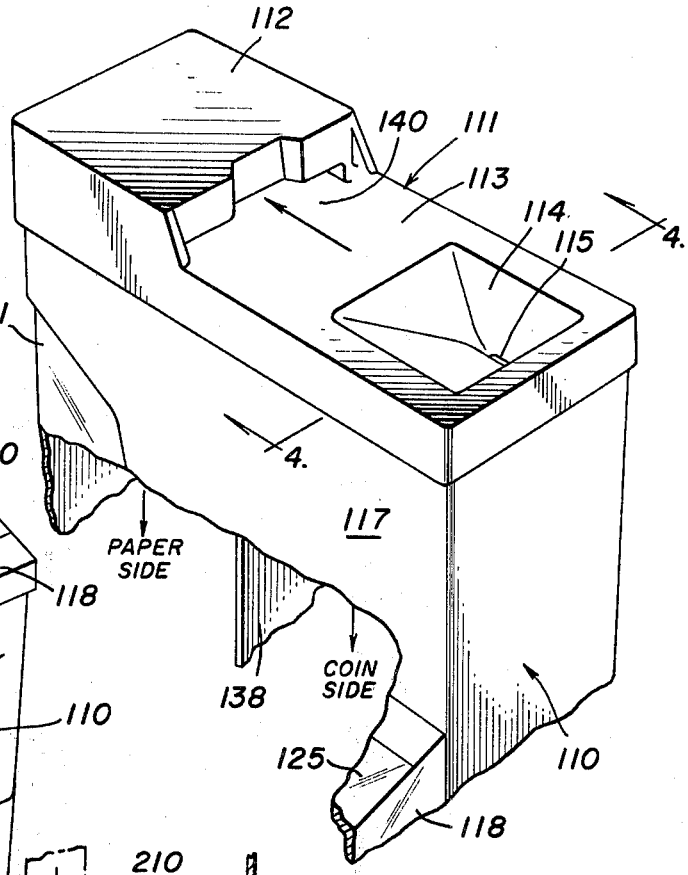
FIG. 2 is an enlarged view of the upper portion of the fare box of FIG. 1 with certain portions broken away and illustrating the coin entry slot and the paper entry slot therein.
Figure 16:
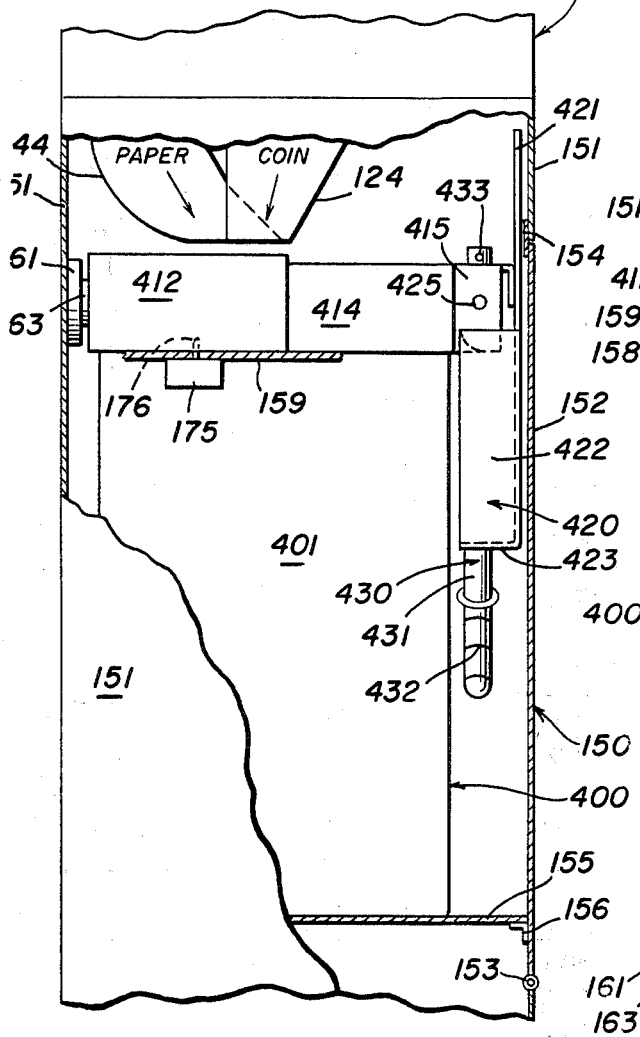
FIG. 16 is an enlarged view with certain parts broken away of the pedestal of the fare box of FIG. 1 and illustrating the cash box therein.
Figure 17:
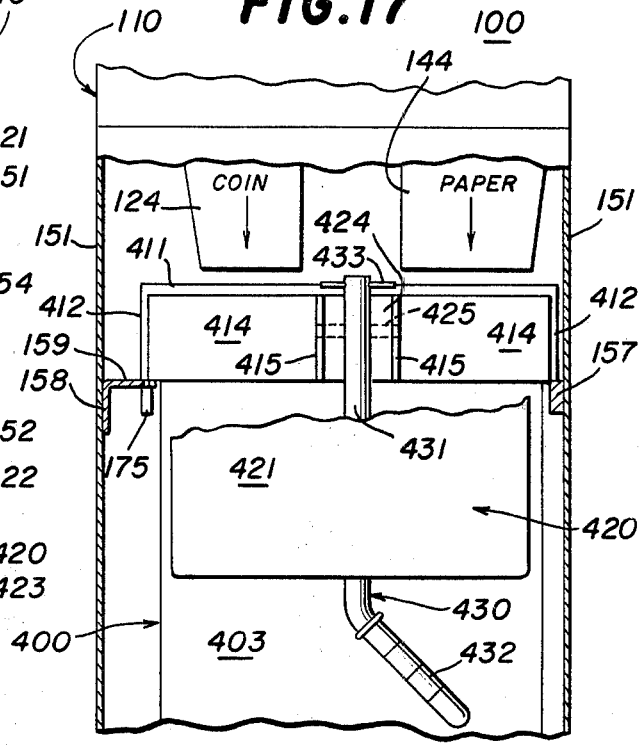
FIG. 17 is a fragmentary view similar to FIG. 16 as viewed from the right in FIG. 16.
Figure 19:
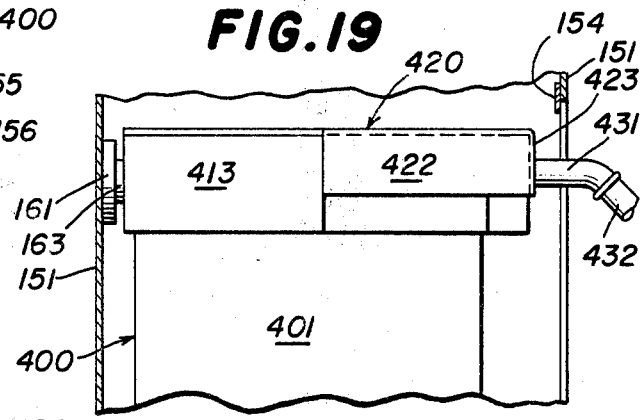
FIG. 19 is a side view of the cash box showing the cover in the closed position thereof.
Figure 18:
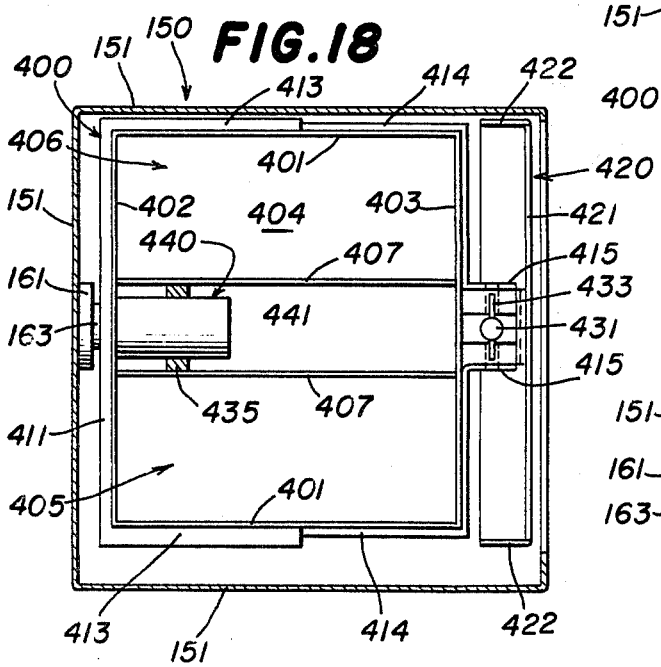
FIG. 18 is a view in horizontal section illustrating the upper end of the cash box with the cover thereof in the open position.
Figure 20:
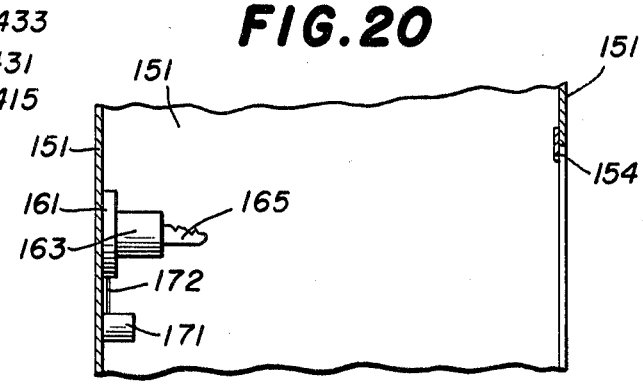
FIG. 20 is a view of the fare box pedestal after removal of the cash box therefrom.
Figure 21:
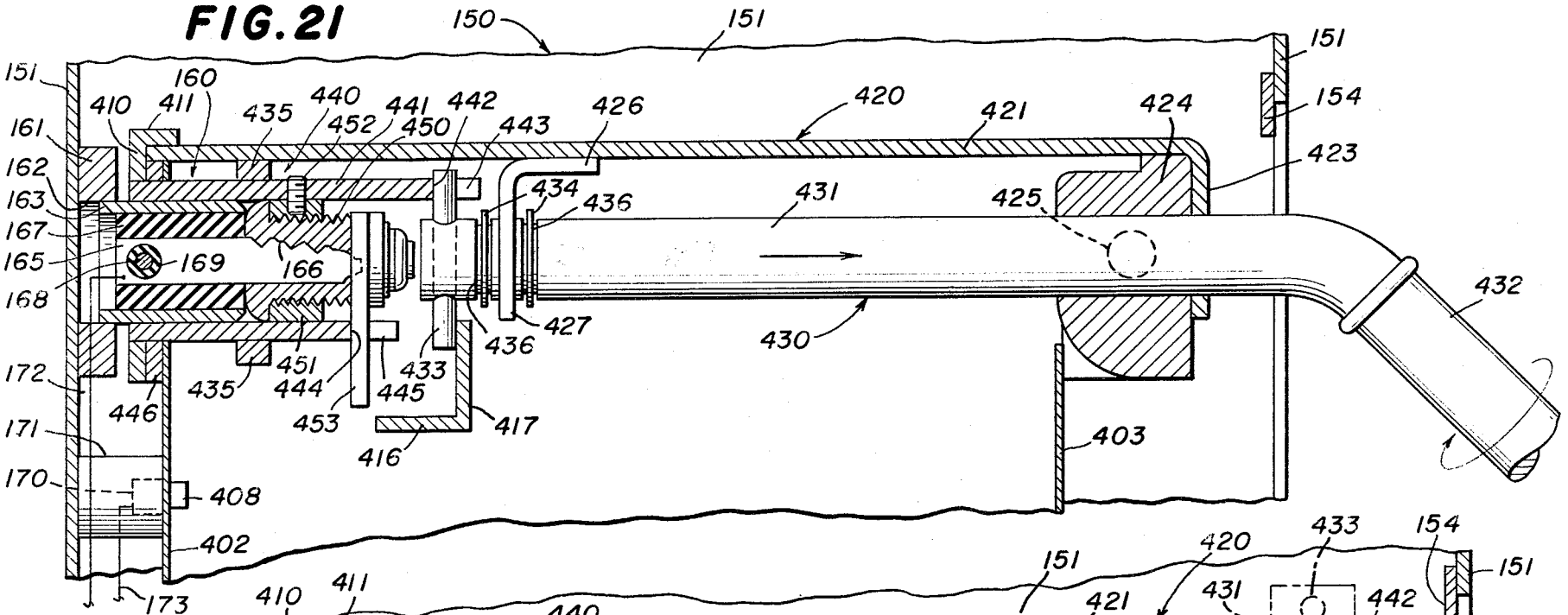
FIG. 21 is a further enlarged view in vertical section through the lock mechanism for the cash box cover with the parts shown in the locked positions thereof.
Figure 22:
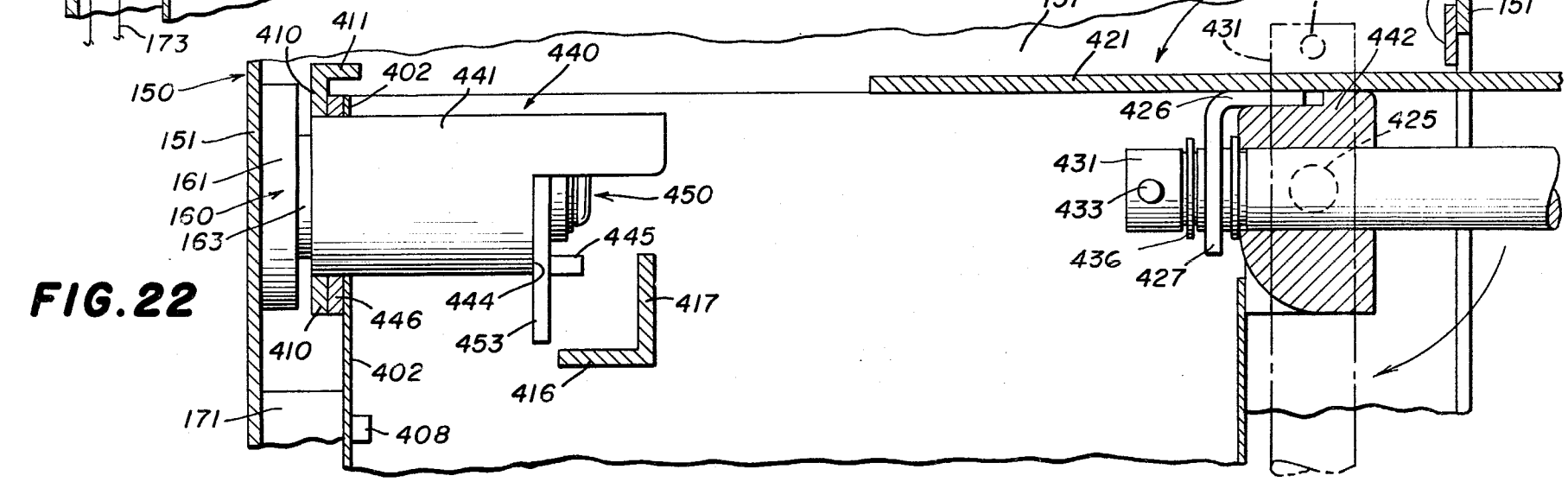
FIG. 22 is a view similar to FIG. 21 and showing the parts in the unlocked and cover open position thereof.

Referring to FIGS. 1 and 2 of the drawings, there is illustrated a fare box generally designated by the numeral 100 made in accordance with and embodying the principles of the present invention, and more specifically incorporating therein the coin singulating and counting device 200 of the present invention (see FIG. 4) and also the cash box 400 of the present invention (see FIG. 16). The fare box 100 includes a top 110 having a feeding head 111 thereon all supported by a pedestal 150. The feeding head 111 is preferably formed as one piece from a suitable metal, such as aluminum, and includes an upper top wall 112 and a lower top wall 113, the lower top wall 113 having an infeed hopper 114 therein communicating with a coin slot 115. The top 110 has a lower portion 116 which is essentially rectangular in cross section and sits upon the pedestal 150 and is securely fastened thereto. An upper portion 117 of small cross section extends upwardly from the lower portion 116, and a coin viewer portion 118 is provided to the right as viewed in FIG. 1. To the left of the coin viewer portion 118 is a fare class panel 119 that is readily accessible to the driver of the vehicle on which the fare box 100 is mounted.

Figure 3:
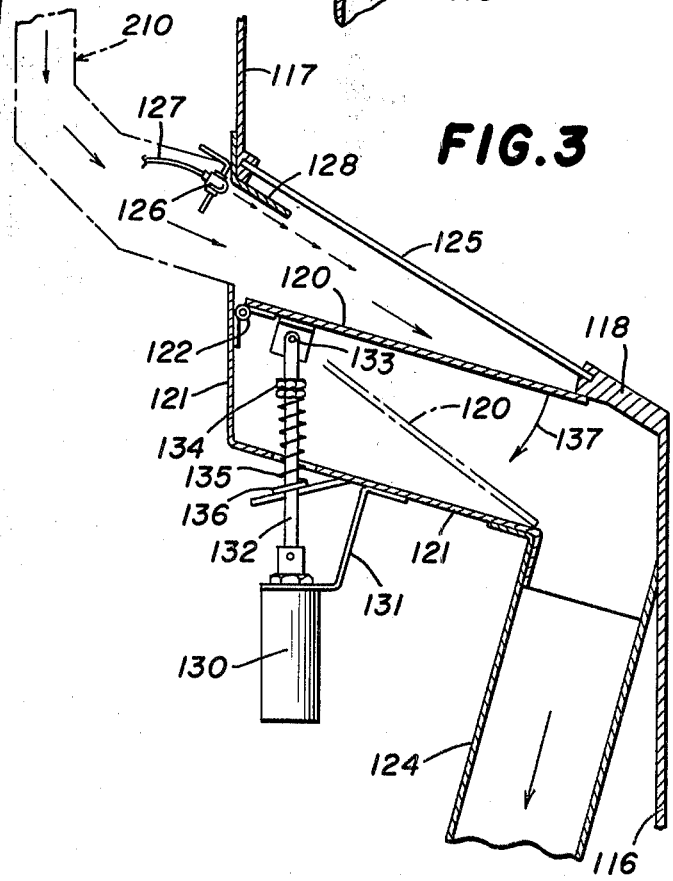
FIG. 3 is an enlarged view in section through the upper portion of the fare box along the line 3—3 of FIG. 1 and illustrating the coin dump assembly.
Figure 5:
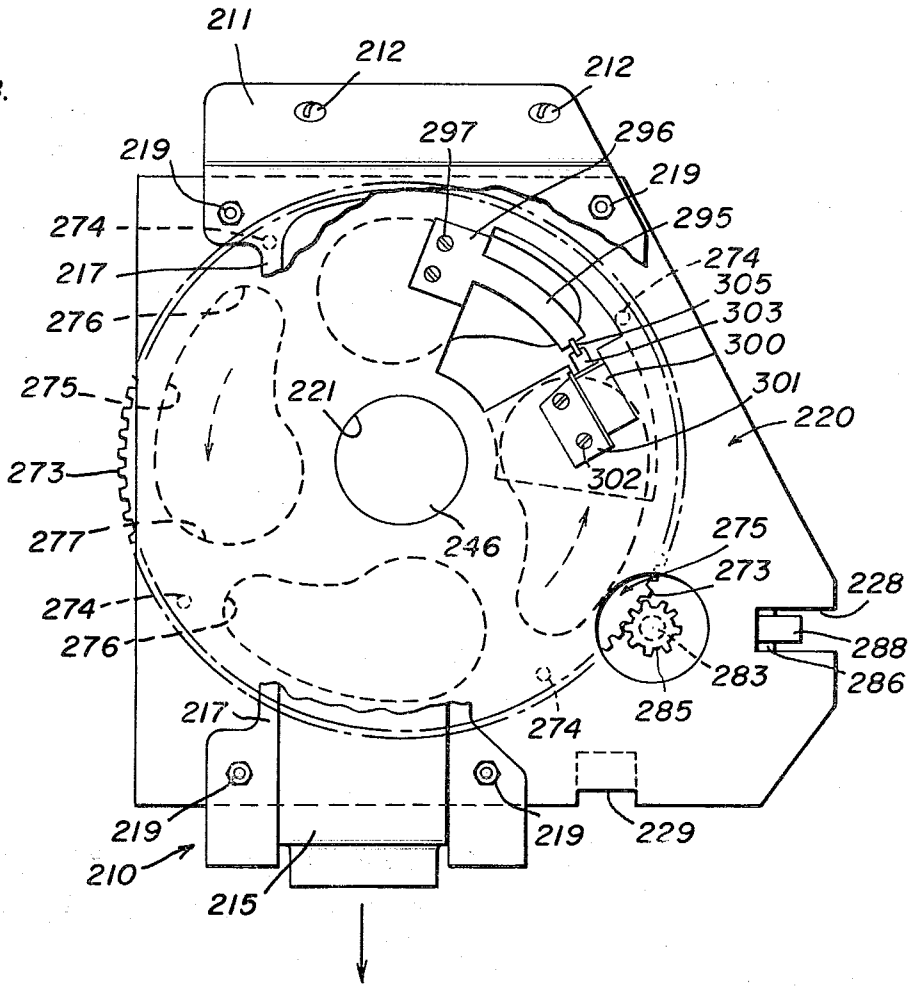
FIG. 5 is a view in section along the line 5—5 of FIG. 4.

As a customer approaches the fare box 100, he is positioned to the right thereof as viewed in FIGS. 1 and 2 and has immediate access to the coin hopper 114 to deposit coins therein. The coins fall through the slot 115 and then through the coin singulating and counting device 200 of the present invention and eventually exit therefrom through an exit chute 210, all to be described more fully hereinafter. As best seen in FIG. 3, the coins issuing from the exit chute 210 fall onto a dump door 120 that is mounted on a support 121 by means of a hinge 122 and is normally in the position illustrated by solid lines in FIG. 3 when receiving coins thereon. The dump door 120 is movable to a position disposed clockwise and in dashed lines to dump the coins thereon into a lower discharge chute 124. The dump door 120 is visible to the driver of the vehicle in which the fare box 100 is mounted through a glass panel 125 which is illuminated by a light 126 receiving electrical energy through wires 127, a light shield 128 being provided so as not to have a glare from the light 126.

After checking the correctness of the fare on the dump door 120, the operator through fare classification switches (to be described more fully hereinafter) energizes a solenoid 130 that moves the dump door 120 from the solid line positions to the dashed line positions thereof in FIG. 3. The solenoid 130 is mounted on a solenoid base 131 secured to the support 121 and has an armature 132 extending upwardly therefrom and pivotally connected as at 133 to the dump door 120. Two adjusting nuts 134 are provided to trap a spring 135 between the nuts 134 and a retainer 136, the spring 135 urging the dump door 120 to the solid line or closed position thereof.

The operator records in the data collection unit forming a part of the fare box 100 the class of fare by means of a plurality of switches 145 through 149 so as to classify fares as "full", "student", "senior citizen", etc. Actuation of one of the switches 145 through 149 serves to actuate the solenoid 130. Should the operator within a predetermined period of time fail to actuate one of the switches 145 to 149, circuitry (not shown) actuates the solenoid 130 to operate the dump door 120. If the amount of coins placed in the dump door 120 has a weight such as to overcome the compression spring 135, then the weight of those coins will also cause the dump door 120 to move to the dumping position thereof.

If the passenger instead of offering coins as the fare offers paper, that paper is moved in the direction of the arrow in FIG. 2 into a paper slot 140 in the feeding head 111. The paper may be in the form of currency or in the form of a transfer or in the form of a ticket. The paper is counted and measured by a mechanism mounted in the fare box 100 and thereafter falls past the transparent cover 141 visible to the operator onto a dump door like the dump door 120 described above. Entry of the fare classification by actuation of the switches 145 to 149 causes energization of a solenoid to open the dump door to drop the paper into a paper chamber. As is best illustrated in FIG. 2, a wall 138 is provided vertically within the upper portion 117 to segregate the coins entering the coin slot 115 to the right thereof and to segregate the paper entering the paper slot 140 to the left thereof. The apparatus for counting and measuring the paper entering the slot 140 is illustrated and described in U.S. application Ser. No. 855,970 referred to above and the disclosure thereof is incorporated herein in its entirety by reference.

The pedestal 150 is essentially rectangular in cross section and includes four outer side walls 151. The top 110 is secured to the pedestal 150 by fasteners that are accessible only through an access door in the top 110 (see FIG. 16). The lower portion of the pedestal 150 receives therein the cash box 400 that will be described more fully hereinafter.

Figure 4:
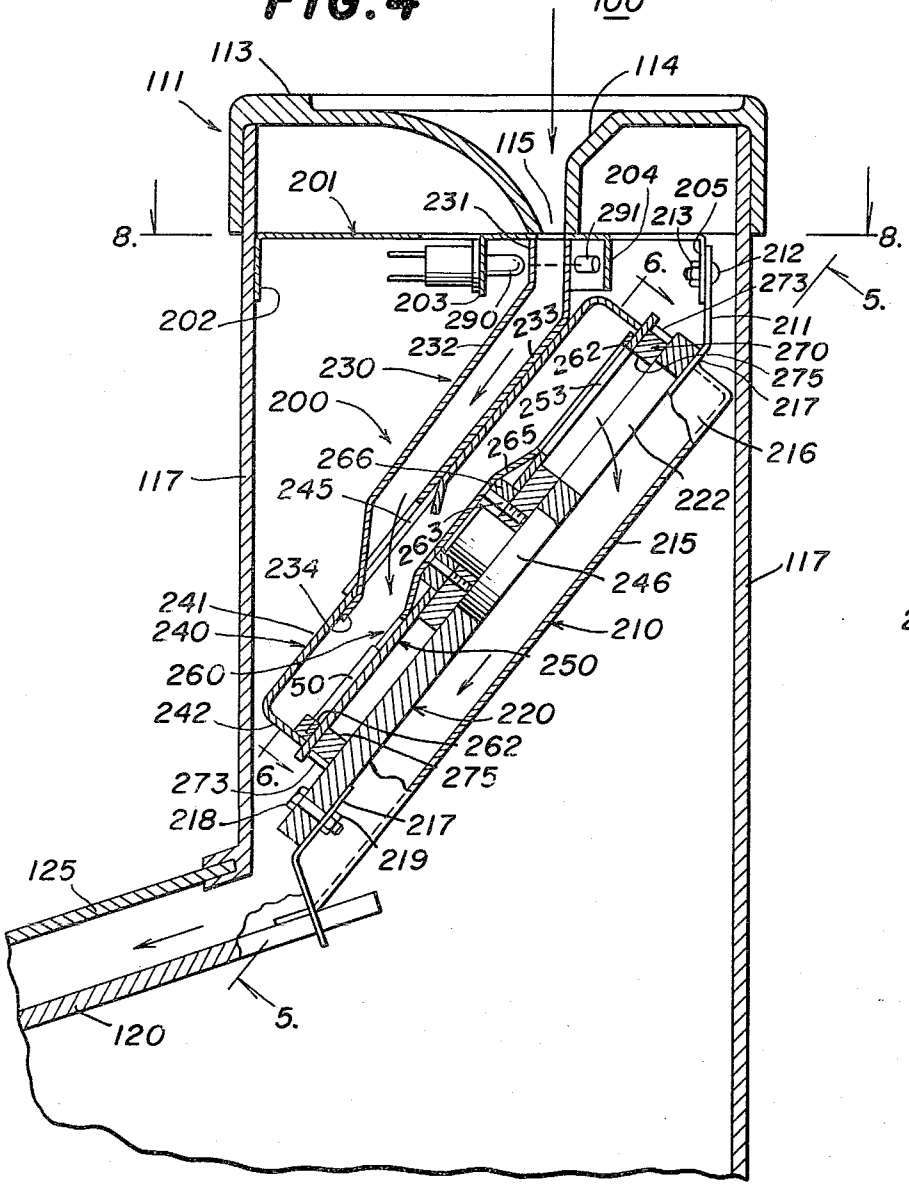
FIG. 4 is an enlarged view in vertical section through the fare box of FIGS. 1 and 2 along the line 4—4 of FIG. 2.

Referring to FIGS. 4 to 15 of the drawings, there is illustrated the construction and operation of the coin registering device or coin singulating and counting device 200 that is used in the fare box 100. The coin singulating and counting device 200 is disposed immediately below the coin slot 115 in the upper portion 117 and discharges the coins therefrom onto the dump door 120 (see FIG. 3). In order to mount the coin singulating and counting device 200 within the fare box 100, a top mounting bracket 201 is provided extending horizontally as illustrated in FIG. 4 and including an attachment flange 202 securing the mounting bracket 201 to the upper portion 117. Extending downwardly from the mounting bracket 201 are mounting flanges 203, 204 and 205 that will be described more fully hereinafter. Secured to the mounting bracket 201 is an exit chute 210 that is stationary and includes an attachment flange 211 that extends upwardly and overlies the flange 205, the overlying flanges having aligned openings therein receiving a bolt 212 having a cooperating nut 213 securely to connect the same. The exit chute 210 has a main wall 215 and side walls 216 normal thereto which carry thereon a mounting flange 217.

Figure 9:
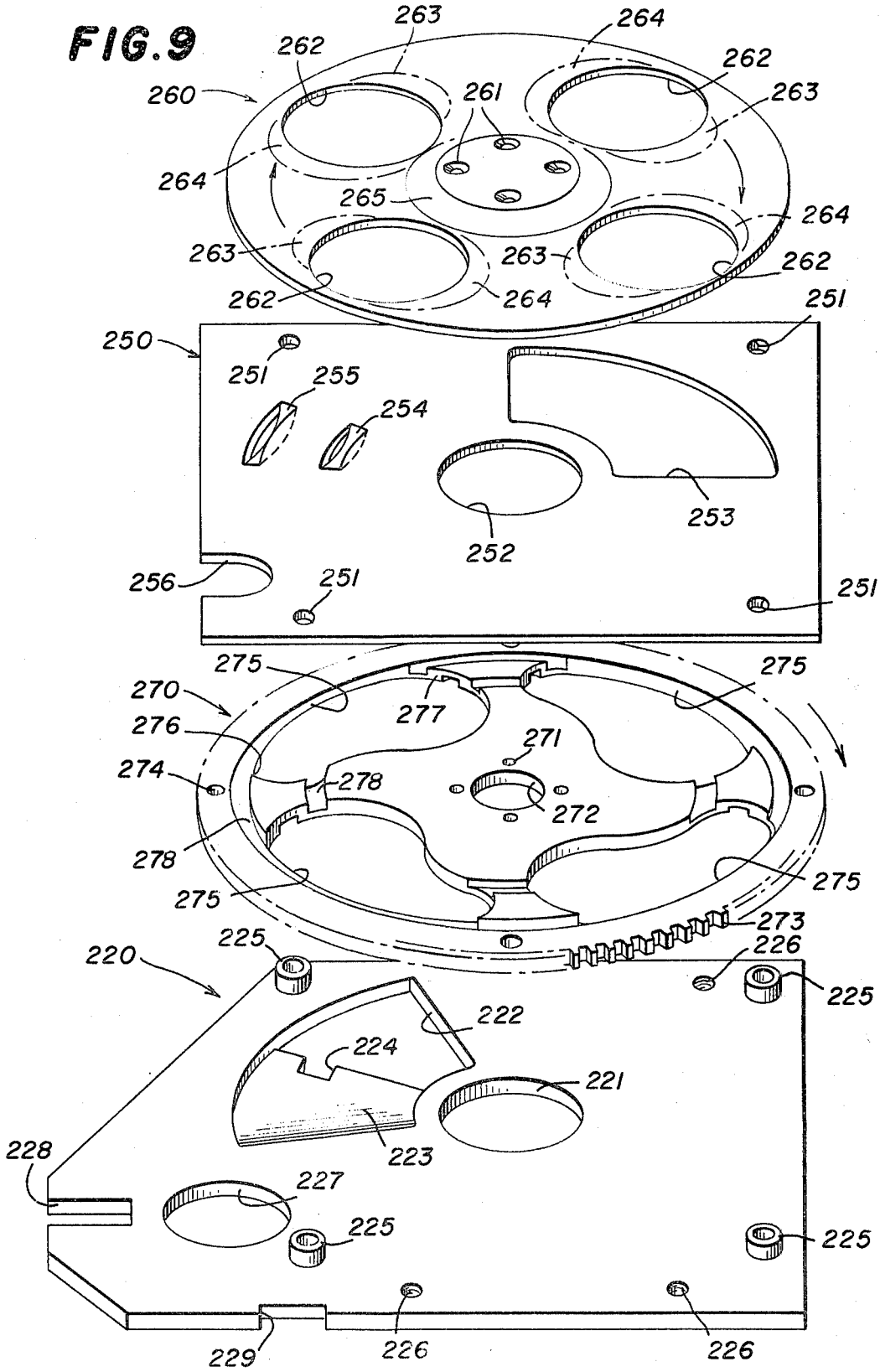
FIG. 9 is an exploded view showing the four principal parts of the coin singulating and counting device of the fare box of FIGS. 1–8.

Firmly secured to the exit chute 210 is a mounting plate 220 that is stationary and secured to the exit chute 210 by bolts 218 and nuts 219. Certain details of construction of the mounting plate 220 are best illustrated in FIG. 9 of the drawings wherein it will be seen that the mounting plate 220 has a central opening 221 and an arcuately arranged coin exit opening 222, one edge of which is defined by a coin discharge ramp 223 in the form of a surface tapering downwardly from the upper surface of the mounting plate 220 to a free edge (see FIG. 11 also). The coin discharge ramp 223 has a notch 224 therein the purpose of which will be described more fully hereinafter. A plurality of cylindrical spacers 225 are provided as well as threaded openings 226 to be associated therewith. A hole 227 for receiving a drive shaft is provided as well as a notch 228 and a notch 229.

Mounted above the mounting plate 220 is an entry chute 230 having a top portion 231 in alignment with the coin slot 115 to receive coins therethrough and integral with the top portion 231 a top wall 232 and a bottom wall 233 essentially parallel to one another, the top wall 232 carrying a flange 234 at the lower end thereof. Secured to the entry chute 230 is a stationary cover 240 having a main wall 241 with integral side flanges 242 extending therearound and attachment flanges 243 (see FIG. 6 also). There is formed essentially in the lower central portion of the main wall 241 a coin-receiving opening 245 through which coins can fall following the arrows through the coin slot 115 and down the entry chute 230 and through the coin-receiving opening 245 in the cover 240, the flange 234 on the entry chute 230 being secured to the cover main wall 241.

Fixedly secured with respect to the mounting plate 220 and the cover 240 is a transfer plate 250, certain details of the construction thereof being best seen in FIG. 9 of the drawings. The transfer plate 250 is essentially rectangular in shape and has four mounting openings 251 in the corners thereof. Centrally of the transfer plate 250 is an opening 252 adjacent to which is provided an arcuate coin-receiving opening 253, the coin-receiving opening 253 having a circumferential extent of 90°. Two coin guiding surfaces 254 and 255 are pressed downwardly from the body of the transfer plate 250, the surfaces 254 and 255 being arcuate on the lower surfaces thereof and convex in shape for a purpose to be described more fully hereinafter. A cutout 256 is provided on one edge of the transfer plate 250 to accommodate drive mechanism as will be described more fully hereinafter.

In order to singulate the coins dropping through the entry chute 253, a rotating singulator disk 260 is provided, certain details of construction thereof being best illustrated in FIG. 9 of the drawings. The singulator disk 260 has an upraised central section 265 carrying four equiangularly spaced mounting holes 261 therein. Four coin singulating pockets 262 are equiangularly arranged around the singulator disk 260, the singulating pockets 262 being of the open bottom type. In operation, the singulator disk 260 rotates in the direction of the arrows thereon in FIG. 9 and the leading edges 263 are raised to a height greater than the thickness of the thickest coin to be received within the singulating pockets 262 and each of the trailing edges 264 is ground away to provide a surface having a thickness less than the thickness of the thinnest coin to be presented to the singulating pockets 262. In an example wherein U.S. coins are to be singulated and counted, each of the singulating pockets 262 is of a size to receive a half dollar therein and the leading edges 263 are formed upwardly so as to provide an effective height thereof greater than the thickness of a half dollar. The trailing edges 264 are ground away so as to have a thickness less than that of a dime or 10¢ piece.

Disposed between the mounting plate 220 and the transfer plate 250 is a coin sizing disk 270 that is mounted for rotation with respect to the mounting plate 220 and the transfer plate 250 and for rotation with the singulator disk 260. More specifically, a spacer 266 is provided beneath the raised section 265 and has openings therethrough receiving bolts 267 (see FIGS. 6 and 10) that serve to interconnect the singulator disk 260, the spacer 266 and the coin sizing disk 270. A spindle 246 is provided carried by the mounting plate 220 and rotatably carrying the singulator disk 260 and the coin sizing disk 270, suitable needle bearings 247 being provided (see FIG. 10 for details of the mounting).

Certain details of construction of the coin sizing disk 270 are best illustrated in FIGS. 9, 14 and 15 wherein it will be seen that the coin sizing disk 270 is essentially circular in shape and has four equiangularly arranged mounting holes 271 centrally thereof that receive the mounting bolts 267. A central opening 272 is provided that receives the spindle 246 that mounts the coin sizing disk 270 for ready rotation. Formed around the periphery of the coin sizing dish 270 are drive teeth 273 and four equiangularly arranged sensing holes 274 are also provided around the periphery and slightly inwardly with respect to the teeth 273. Four coin sizing pockets 275 of the open bottom type are provided equiangularly about the disk 270. Each of the sizing pockets 275 has a smaller end 276 which is shaped and sized snugly to receive the smallest coin to be counted therein, and each of the sizing pockets 275 has a larger end 277 that is shaped and sized snugly to receive the largest coin to be counted therein. Two top slots 278 are provided in the upper surface of the disk 270 and a bottom slot 279 extends therearound on the lower surface and is disposed between the top slots 278 (see FIG. 15 particularly).

In order to drive the assembly of the singulator disk 260 and the coin sizing disk 270, a drive motor 280 has been provided (see FIGS. 6 and 7 particularly), the motor 280 preferably being an electrical motor of the type that can be quickly started and stopped. The motor 280 is mounted on the mounting plate 220 by means of a mounting bracket 281, a plurality of screws 282 passing through the bracket 281 and into the mounting plate 220. The motor 280 has a shaft 283 that extends upwardly therefrom and carries on the upper end a driving gear 285. The teeth on the gear 285 are the same size and pitch as the drive teeth 273, whereby the driving gear 285 by engaging the drive teeth 273 serves to drive the disks 260 and 270. Also driven by the motor 280 is a timing disk 286 which has a plurality of indicia 287 in the form of radial lines thereon (see FIG. 6 particularly) which are sensed by a sensor 288 forming a part of the measuring and control circuit of the present invention. Actuation of the motor 280 is initiated by the interruption of a light beam from a light source 290 mounted on the flange 203 adjacent to the top portion 231 of the entry chute 230 (see FIGS. 4 and 8 particularly). Associated with the light source 290 are two sensors 291 that are angularly displaced so that a coin of the smallest size will interrupt the light beam no matter where the coin is within the top portion 231, thus to insure that the drive motor 280 is actuated each time that a coin is inserted into the fare box 100.

Figure 10:
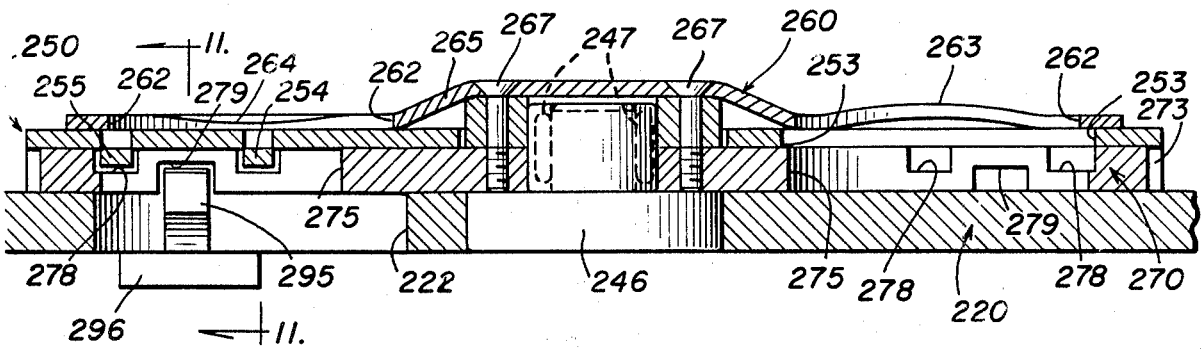
FIG. 10 is an enlarged view in section along the line 10—10 of FIG. 6.
Figure 11:
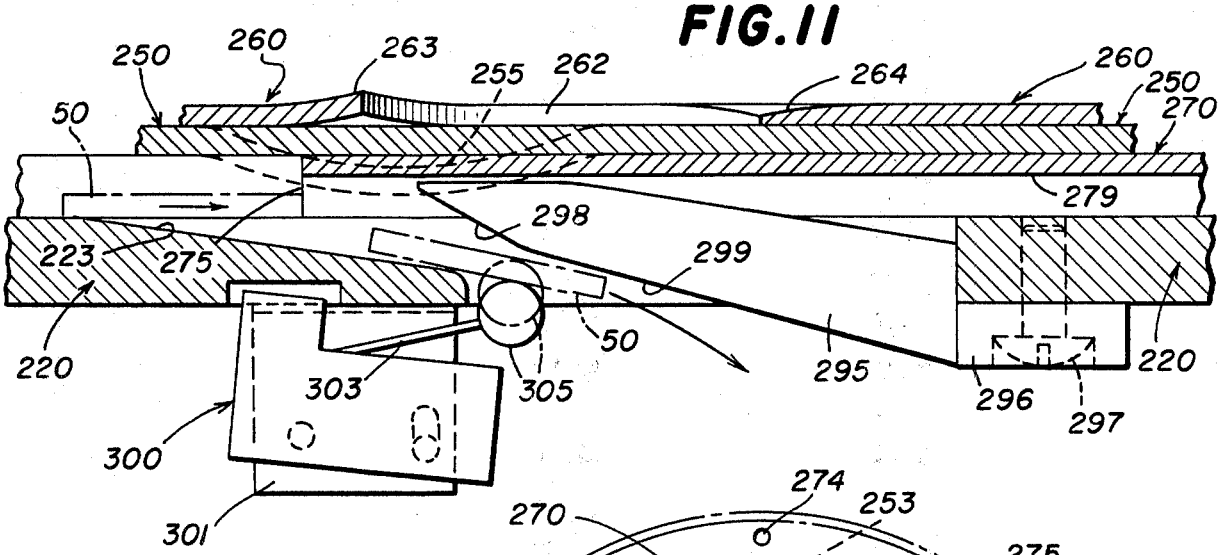
FIG. 11 is a further enlarged fragmentary view in section along the line 11—11 of FIG. 10.
Figure 12:
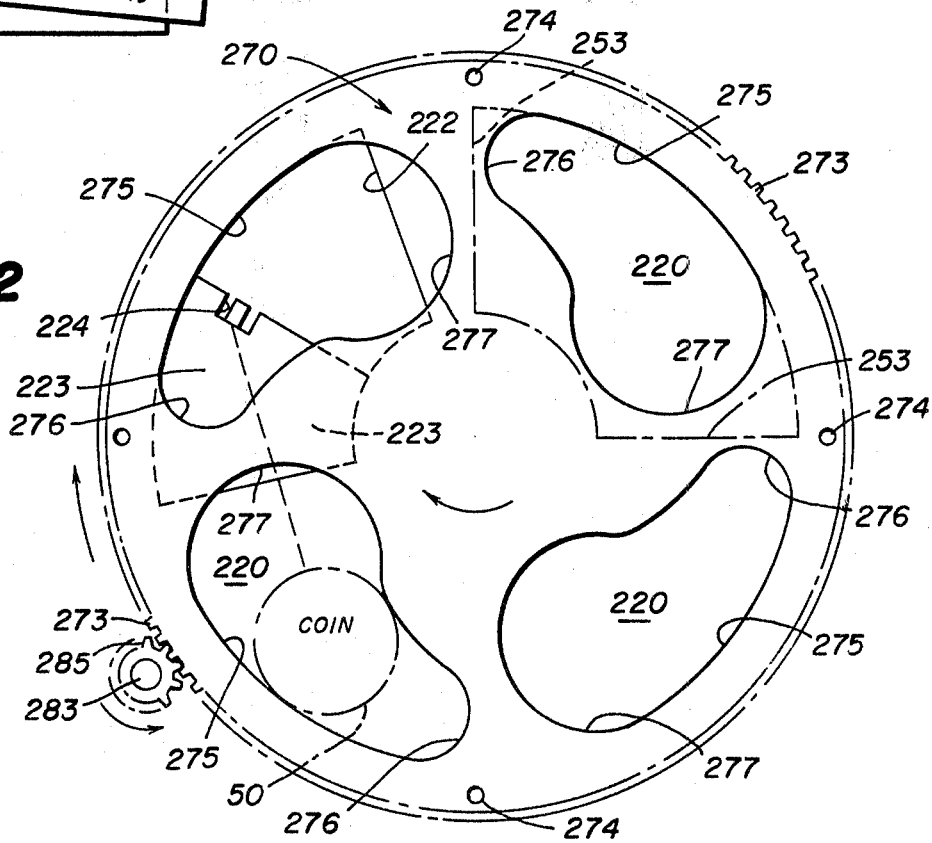
FIG. 12 is a diagrammatic view illustrating the relationship between the coin sizing disk and the mounting plate associated therewith.

Referring to FIGS. 10 and 11 of the drawings, it will be seen that the top slots 278 in the coin sizing disk 270 receive therein the coin guiding members 254 that are struck downwardly from the transfer plate 250, and that there is disposed in the bottom slot 279 of the coin sizing disk 270 an ejector 295 that serves to extract a coin from one of the sizing pockets 275 and to direct the same downwardly through the coin exit opening 222 in the mounting plate 220. The ejector 295 is provided with a mounting flange 296 that is secured by screws 297 to the underside of the mounting plate 220. The ejector 295 is in the form of a finger extending upwardly through the coin exit opening 222 and overlying the exit edge of the coin discharge ramp 223. The ejector 295 has a deflecting surface 298 that in part overlies the exit edge of the coin discharge ramp 223 and directs coins downwardly out of the sizing pocket 275. The ejector 295 also has a guide surface 299 which guides the extracted coins downwardly and out of the coin exit opening 222 and into the coin exit chute 210 (see FIG. 4), all as will be described more fully hereinafter.

Also mounted on the underside of the mounting plate 220 adjacent to the coin exit opening 222 is a coin exit switch 300 mounted on the plate 220 by means of a mounting bracket 301 (see FIG. 5 also) by means of screws 302. The switch 300 has the usual actuating arm 303 that carries on the outer end thereof a contact or sensor 305 that is normally disposed immediately adjacent to the exit edge of the coin discharge ramp 223 and below the ejector 295 (see FIG. 11) and in sufficiently close proximity to the ejector 295 so that even the smallest coin, such as a U.S. dime, deflects the contact 305 a sufficient distance to cause the arm 303 to actuate the switch 300 which is of the microswitch variety. More specifically, the leading edge of a coin, such as the coin 50, will actuate the switch 300 as the coin 50 exits the coin discharge ramp 223 under the ejector 295. Referring to FIG. 13, it will be seen that there also has been provided a proximity sensor 310 on a mounting bracket 311 secured to the mounting plate 220 by screws 312. The proximity sensor 310 has a sensing head 315 that is positioned to be in alignment with the sensing holes 274 on the coin sizing disc 270 so as to detect the passage of the sensing holes 274 past the sensing head 315.

It further is pointed out that the singulator disk 260 and the coin sizing disk 270 rotate about an axis that is inclined with respect to the vertical and rotate in planes that are also inclined with respect to the horizontal, the inclination of the planes of rotation of the disks 260 and 270 with respect to the horizontal being preferably 50° as illustrated. This angle of inclination of the planes of rotation of the disks 260 and 270 to the horizontal may vary from about 40° to about 60°.

In the operation of the coin singulating and counting device 200, coins are fed through the slot 115 and into the entry chute 230 and past the light source 290 so as to interrupt the light beam to one or both of the sensors 291. Interruption of the light beam to one or the other of the sensors 291 energizes all of the electrical circuitry and specifically begins operation of the motor 280 so as to turn the singulator disk 260 and the coin sizing disk 270; it will be appreciated that simultaneously the electrical circuitry including the coin exit switch 300, the proximity sensor 310 and the sensing head 315 are also actuated.

The coins are directed by the entry chute 230 to the opening 245 in the cover 240 and thereby cause the coins to fall upon the portion of the singulator disk 260 disposed downwardly and below the center thereof and to the left in FIG. 4. The coins introduced into the device 200 may be of any variety and may have substantially differing diameters and thicknesses. For purposes of illustration, it will be assumed that the coins introduced into the fare box 100 are U.S. coins, and more specifically are dimes, pennies, nickles, quarters and half dollars. From the mass of coins present in the bottom of the cover 240 one of the coins will fall into the then lowermost one of the singulating pockets 262 and will be carried upwardly and away from the viewer in FIG. 4 and toward the upper right in FIG. 4. Since the trailing edge 264 has a thickness less than the thickness of the thinnest coin, i.e., less than the thickness of a dime, there will be but a single coin picked up in the singulating pocket 262, any additional coins sliding therefrom and downwardly toward the bottom of the cover 240 to be picked up by a succeeding one of the singulating pockets 262. In this fashion, a single coin is picked up in each of the singulating pockets 262 and carried upwardly and away from the viewer in FIG. 4 toward the upper righthand portion thereof.

Figure 6:
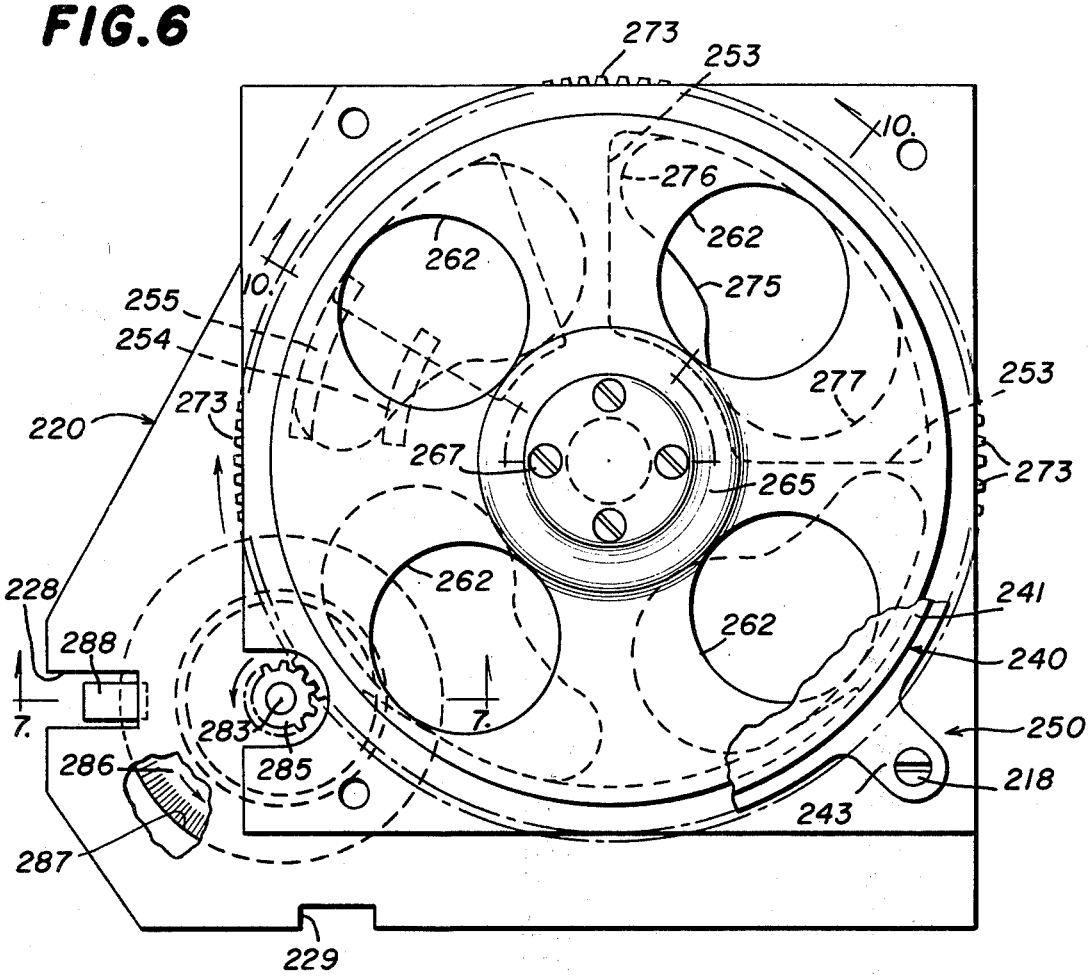
FIG. 6 is a view in section along the line 6—6 of FIG. 4.
Figure 7:
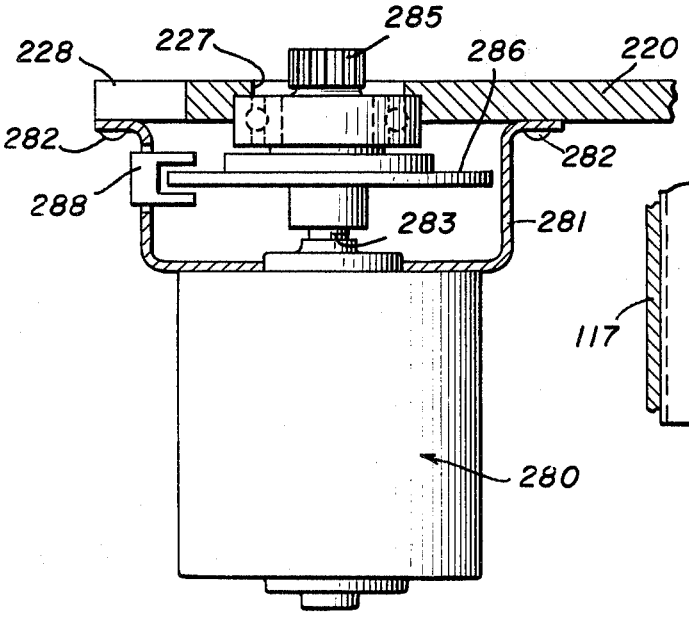
FIG. 7 is a view in section along the line 7—7 of FIG. 6.
Figure 8:
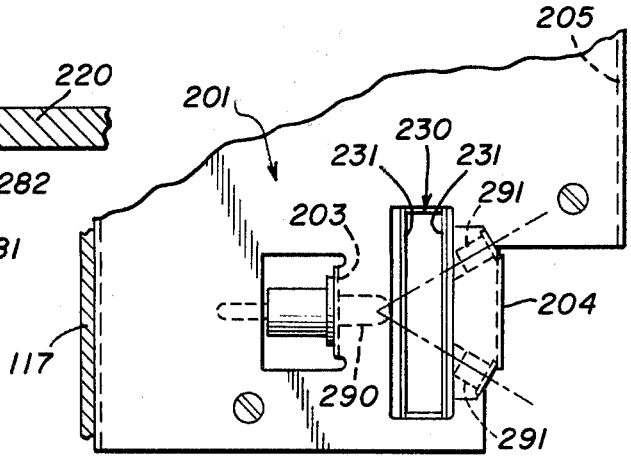
FIG. 8 is a fragmentary view in horizontal section along the line 8—8 of FIG. 4.

The first singulating pocket 262 carrying a coin will arrive at the top of the arc of movement thereof at which time that singulating pocket 262 comes into registry with the coin receiving opening 253 in the transfer plate 250 (see FIG. 6 for a diagrammatic representation thereof). The single coin will fall through the opening 253 and into a coin sizing pocket 275 on the sizing disc 270 that is in registry with the coin singulating pocket 262. More specifically, the coin will ride upon the upper surface of the mounting plate 220 while disposed in the associated sizing pocket 275 and will be carried downwardly and in a sense be sandwiched between the transfer plate 250 and the support plate 220 while disposed in the associated sizing pocket 275. The coin is carried in this fashion downwardly and to the bottom left as viewed in FIG. 4 and then upwardly away from the inverter in FIG. 4 and eventually will be fed onto the coin discharge ramp 223 of the mounting plate 220 where the coin will be pressed against the coin discharge ramp 223 by the coin guiding members 254 and 255. The leading edge of the coin, such as the coin 50 in FIG. 11, will be forced further downwardly by the deflecting surface 298 on the ejector 295 and into contact with the sensor 305 on the coin exit switch 300, thus to actuate the switch 300, the leading edge of the coin 50 actually causing actuation of the switch 300. The guide surface 299 on the ejector 295 continues to guide the coin 50 downwardly as viewed in FIG. 11 and out of the coin exit opening 222 in the mounting plate 220 and thus into the exit chute 210. The exit chute 210 empties onto the dump door 120 and to the lower left as viewed in FIG. 4.

In order to detect the size and denomination of the coin being fed and to accomplish the counting of the coins being fed, the four sensing holes 274 associated with the four sizing pockets 275 have been provided. As the associated hole 274 passes the sensing head 315, a counter mechanism is actuated that counts the indicia 287 on the timing disk 286 and the counting continues until the leading edge of the coin, such as a coin 50 in FIG. 11, actuates the coin exit switch 300, at which time the counting of the indicia 287 is terminated. Referring to FIG. 14, it will be seen that each denomination of coin occupies a particular position within the associated coin sizing pocket 275, whereby to position the leading edge of each coin at a distance farther away from the associated sensing hole 274. For example, a dime being the smallest (designated by the numeral 50) is snugly seated within the trailing portion of the sizing pocket 275 and against the smaller end 276 thereof. The penny on the other hand is positioned a short distance clockwise with respect to the dime, the penny being designated by the numeral 51 in FIG. 14. The quarter, designated by the numeral 53, has the leading edge thereof disposed further in a clockwise direction, while the half dollar, designated by the numeral 55, has its leading edge disposed against the larger end 277 of the sizing pocket 275. As a consequence, the leading edges of the several coins 50, 51, 53 and 55 will arrive at the exit switch 300 at different times. In this fashion, the identity of the coin within the sizing pocket 275 can be determined, it being noted that the larger the coin the quicker it arrives at the exit switch 300 and the shorter the time interval between the sensing of the sensing hole 274 by the sensing head 315 and the actuation of the exit switch 300. In this fashion, the identity of the coin in the coin sizing pocket 275 can be rapidly and accurately ascertained. Actuation of the exit switch 300 also serves as a counting mechanism, whereby the identity and the fact of its passage through the coin singulating and counting device 200 of the coin can be registered.

Disposed within the pedestal 150 of the fare box 100 is a cash box 400 for receiving the coins that are inserted through the coin slot 115 and for receiving the paper inserted through the paper slot 140, the details of construction of the cash box 400 being best illustrated in FIGS. 16 to 22 of the drawings. It will be seen that the pedestal 150 has in one of the side walls 151 thereof a door 152 hinged as at 153 and bearing against an abutment 154, the door 152 being normally held in the closed position by a key actuated lock (not shown). Disposed within the pedestal 150 is a transverse wall 155 that is supported by angle irons 156, and referring to FIG. 17, it will be seen that a guide 157 is disposed to the right therein and a bracket 158 providing a guide flange 159 is provided to the left therein.

The cash box 400 is formed as a unitary open-top container having two opposed side walls 401, a rear wall 402, a front wall 403 and a bottom wall 404. Two inner walls 407 parallel to each other and extending the entire width of the cash box 400 divide the cash box 400 into a coin compartment 405 and a paper compartment 406. Mounted on the inside of the rear wall 402 is a permanent magnet 408 (see FIG. 22) which interacts with a Hall effect sensor 170 (see FIG. 21) in a mount 171 carried by the associated side wall 151 of the fare box pedestal 150. A conductor 173 connects the Hall effect switch 170 to the control circuit for the fare box 100. There also is provided on the guide flange 159 a sensor 175 having a probe 176 also forming a part of the control circuit for the fare box 100.

In order to provide adequate security for the cash box 400, it is provided with a cover 420 and the cover is provided with mounting structure on the cash box 400 that insures that the cover remains in the desired position thereof at all times. More specifically, a rear plate 410 is fixedly secured as by welding to the rear wall 402 and has an overlying flange 411 thereon (see FIGS. 21 and 22 particularly). The side walls 401 also carry side plates 412 that have inturned overlying flanges 413. Straps 414 are provided along the side walls 401 at the upper ends thereof that extend around and along the front wall and have outwardly extending hinge flanges 415 thereon. There also is provided internally of the cash box 400 a cross beam 416 which carries an upstanding flange 417 thereon forming a part of the security mechanism for the cover 420.

The cover 420 includes an essentially rectangular top plate 421 that has adjacent to the front portions thereof depending side flanges 422 and an interconnecting front flange 423. Fixedly secured to the front flange 423 is a picot block 424 having stub pivot pins 425 extending thereinto and mounted in the hinge flanges 415, thus hingedly to connect the cover 420 to the flanges 415. The inner surface of the top plate 421 carries a bracket 426 secured thereto as by welding, the bracket 426 including a flange 427 essentially normal to the top plate 421 and having an opening centrally therein.

In order to control the position of the cover 420, a handle 430 has been provided including a shaft 431 that extends through a circular opening in the front flange 423 and through an aligned cylindrical opening in the pivot block 424 and then through the opening in the flange 427. The shaft 431 has spaced-apart grooves 436 receiving retaining rings 434 on either side of the flange 427 so as to be interconnected to the shaft 431 while permitting the shaft 431 to be rotated with respect to the flange 427. The shaft 431 is slidingly engaged with respect to the pivot block 424 for sliding relation with respect thereto and also can pivot with respect to the front flange 423. The righthand end of the shaft 431 as viewed in FIG. 21 carries an angularly disposed gripping portion 432, while the other end of the shaft 431 carries a transverse pin 433 secured therein.

A lock mechanism 440 is mounted on the rear wall 402 of the cash box 400 (see FIGS. 21 and 22 particularly) and includes a cylindrical lock sleeve 441 extending through aligned openings in the rear wall 402 and the rear plate 410 and being secured against longitudinal movement but mounted for rotation about its axis in a support ring 435 secured to the inside walls 407. A first notch 442 is provided in the righthand end of the lock sleeve 441 as viewed in FIG. 21 and provides an abutment surface 443, and a second notch 444 is also provided in the righthand end of the lock sleeve 441 and provides an abutment surface 445. A flange 446 is provided on the wall 402. A lock cylinder 450 is mounted within the lock sleeve 441 and is secured thereto by a support ring 451 held in place with respect to the lock sleeve 441 by a set screw 452. A lock lever 453 is provided fixedly secured to the inside walls 407 to hold one of the inner locking portions of the lock cylinder 450 in proper operative position.

The lock mechanism 440 on the cash box 400 cooperates with a lock mechanism 160 mounted on the fare box pedestal 150, and particularly on one of the side walls 151 thereof. There is provided a ring 161 fixedly secured to the inner surface of the associated side wall 151 and having an inner surface 162 cylindrical in shape. Disposed within the ring 161 is a tube 163 extending to the right as viewed in FIG. 21. Mounted centrally of the tube 163 is a key element 165 having the usual ridges 166 and intervening grooves that cooperate with tumbler structure (not shown) forming a part of the lock cylinder 450. The key element 165 is insulated with respect to the tube 163 by a quantity of rubber fill 167. In order to insure that the key element 165 remains in the proper oriented position, a pin 168 extends through an opening therein and into the side walls of the tube 163, the pin 168 being electrically insulated from the key element 165 by a plastic bushing 169. As a result, the key element 165 is electrically insulated from all parts of the fare box 100. An electrical conductor 172 is connected to the key element 165 and then to the control circuitry for the fare box 100 for a purpose to be described more fully hereinafter.

When the parts are in the position illustrated in FIG. 1, i.e., with the key element 165 of the lock mechanism 160 inserted in the lock cylinder 450 of the lock mechanism 440, and with the handle 430 in the closed position illustrated, the cash box 400 can be removed laterally to the right from the pedestal 150. After such removal of the cash box 400 from the pedestal 150, the lock lever 453 holds the parts of the cash box 400 in the position illustrated, the tumblers in the lock cylinder 450 having moved to a locking position upon removal of the key element 165 therefrom, thus to lock the lock sleeve 441 in the position illustrated in FIG. 21, and thus to hold the pin 433 in engagement behind the flange 417, thus to hold the cover 420 in the locked position thereof. After insertion of the cash box 400 into the pedestal 150 with the resultant insertion of the key element 165 into the lock cylinder 450, the tumblers in the lock cylinder 450 are aligned and released so that now the lock lever 453 can be rotated, thus releasing the lock sleeve 441. This permits rotation of the handle shaft 431 90° to disengage the pin 433 from behind the flange 417, thus to permit withdrawal of the handle shaft 421 to the right from the position illustrated in FIG. 21 to that illustrated in FIG. 22. This then permits the full opening of the cover 420 as will be described more fully hereinafter.

In the use of the cash box 400, the cover 420 is shiftable among a fully closed position, a partially open position and a fully open position. When the cover 420 is in the fully closed position, the side edges of the forward portion of the top plate 421 are disposed below the flanges 413 and the forward edge of the plate 421 is disposed below the flange 411 (see FIG. 21 also). With the parts in this position, the handle shaft 431 is in its fully forward position, i.e., the position illustrated in FIGS. 19 and 21. Assuming that the cash box 400 is removed from the pedestal 150 so that the key element 165 is removed from the lock mechanism 440, the lock mechanism 440 acting through the lock lever 453 fixes the lock sleeve 441, and thus holds the pin 433 on the handle 430 in engagement behind the flange 417. The cover 420 therefor is not only closed but is securely locked in the closed position. The cover 420 can be opened by inserting the appropriate key in the lock mechanism 440 (i.e., in the same position as the lock element 165 in FIG. 21), in which event the lock lever 453 can be released, thus permitting the handle 430 to be rotated 90° to clear the pin 433 from behind the flange 417.

After the unlocking of the lock mechanism 440 either by the key element 165 or an independent key acting in its place, the handle shaft 431 can be rotated 90° to clear the pin 433 from behind the flange 417. After such rotation the handle shaft 431 can be slidably moved to the right from the position essentially illustrated in FIG. 21 to that illustrated in FIG. 22, this serving to move the forward edge of the cover top plate 421 to a position partially to uncover the coin compartment 405 and the paper compartment 406 of the cash box 400. After the parts have been moved to the partially open position, the cover 420 can be pivoted to the fully open position illustrated in FIGS. 16, 17 and 18, the pivoting being about the pivot pins 425. It will be seen that this pivots the handle 430 downwardly so that the shaft 431 is essentially parallel to one of the side walls 403, and the cover 420 is pivoted so as fully to open the top of the cash box 400.

In the use of the cash box 400 in the fare box 100, the access dor 152 is unlocked and opened thus providing access to the interior of the pedestal 150. The cash box 400 is in the closed condition, i.e., the cover 420 is in the fully closed position and the handle 430 is in the closed and locked position thereof. The cash box 400 is inserted into the pedestal 150 with the lower edges of the side plates 412 disposed upon the guides 157 and 159 (see FIG. 17) and in position to actuate the sensor 175 by engaging the probe 176 thereof. Upon insertion of the cash box 400 fully into the pedestal 150, the key element 165 is inserted into the lock mechanism 440 and by the proper engagement of the key element 165 with the tumblers in the lock cylinder 450 serves to free the lock cylinder 450. The handle 430 can now be rotated 90° and the cover 420 withdrawn first to the partial open position, and thereafter pivoted to the full open position illustrated in FIGS. 16, 17 and 18 of the drawings. Such rotation of the handle 430 and subsequent withdrawal thereof moves the lock sleeve 441 to a position wherein the lock mechanism 440 now fixedly engages the key element 165, thus to lock the cash box 400 in the pedestal 150 and to prevent unauthorized withdrawal thereof. In addition to actuating the sensor 175, engagement of the key element 165 in the lock mechanism 440 serves to ground the conductor 172, and the presence of the permanent magnet 408 adjacent to the Hall effect sensor 170 also provides a signal along the conductor 173. Upon receipt of the proper signal from the conductors 172 and 173 and from the sensor 175, the control circuitry for the fare box 100 now is operative to receive, singulate and count coins and to measure and identity paper fed into the fare box 100.

It is noted that although the access door 152 has a key associated therewith, access to the interior of the cash box 400 is not possible so long as the cash box 400 is locked within the pedestal 150, even with the access door 152 open. When it is desired to remove the cash box 400 from the pedestal 150, the operator must first move the cover 420 to the closed position thereof, and thereafter rotate the handle 430 to the position illustrated in FIG. 21. Such rotation serves to unlock and disengage the lock element 165 with respect to the lock mechanism 440, thus to permit removal of the cash box 400 and its contents from the pedestal 150. It is noted however that upon withdrawal of the key element 165 from the lock mechanism 440, the lock mechanism 440 will now be locked into the position to hold the cover 420 in the fully closed position thereof.

Figure 23:
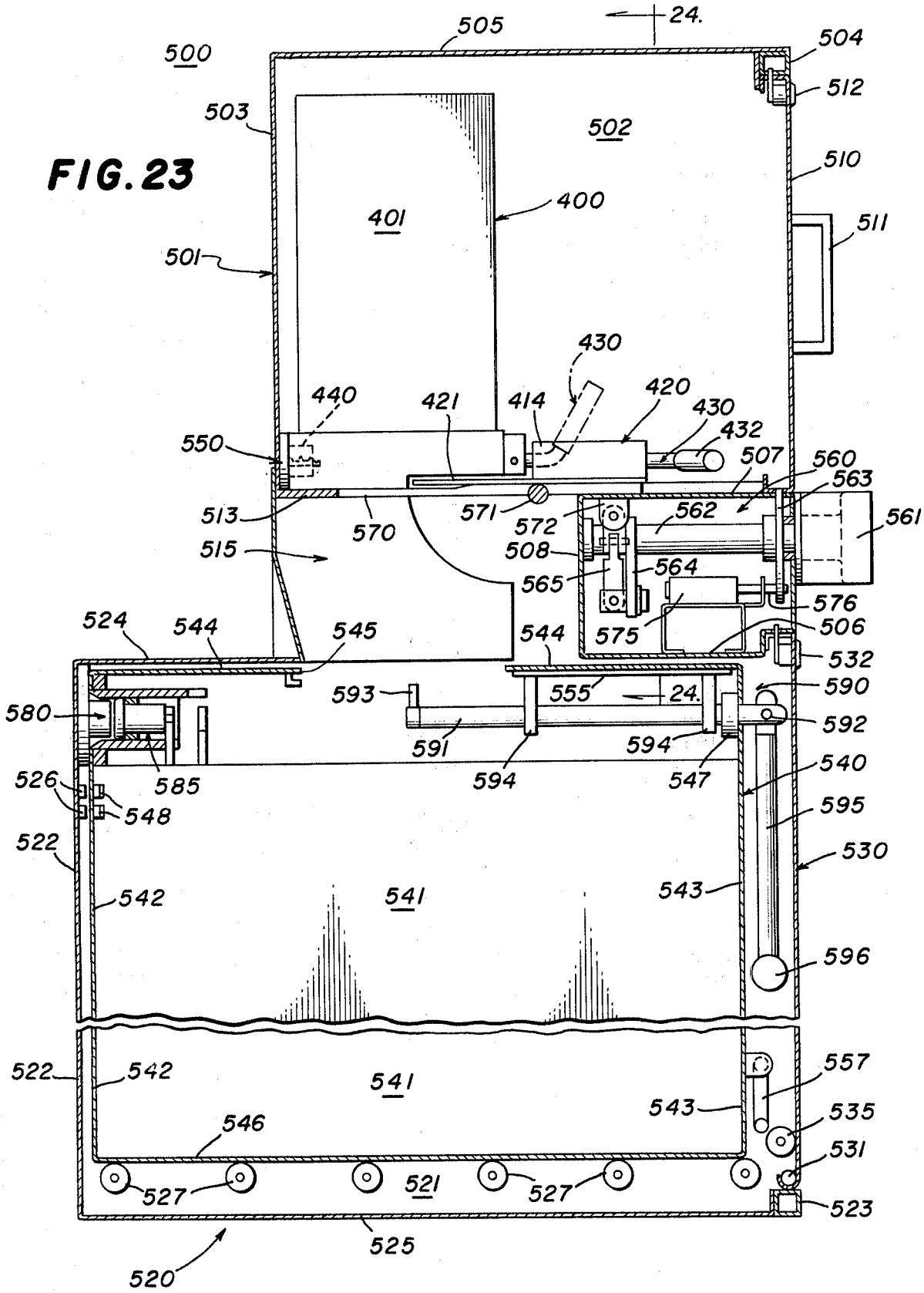
FIG. 23 is a view in vertical section through the master vault and the cash container with the cash box shown in the discharge position with the cover thereof closed.

In accordance with the present invention, the contents of the cash box 400 are preferably transferred to a master vault 500 while the cash box 400 has the cover 420 thereof in the fully closed and locked position, after which the cover 420 is moved to a partially open position and finally under secure conditions removed to the fully open position thereof for transfer of the contents of the cash box 400 to a cash container 540. The construction and operation of the master vault 500 and the cash container 540 therefor are best illustrated in FIGS. 23 to 26 of the drawings. Referring first to FIG. 23, the master vault 500 is provided with an upper compartment 501 and a lower compartment 520. The upper compartment 501 is defined by two side walls 502, a rear wall 503, a front wall 504, a top wall 505 and a bottom wall 506. A horizontal intermediate wall 507 and a transverse wall 508 cooperate with a portion of the bottom wall 506 to provide an inner compartment to be described more fully hereinafter. The upper compartment 501 has in the front wall 504 thereof a door 510 hinged on the side and fixedly secured to a pivoting mounting shaft 514 (see FIG. 24) and having a handle 511. A lock 512 is also provided so that the door 510 can be securely locked in the closed position thereof. Disposed within the upper compartment 501 is a transverse support 513 which assists in supporting the cash box 400 in the emptying position thereof. Disposed beneath the support 513 is a chute 515 that is useful in conveying the contents of the cash box 400 into the cash container 540.

The lower compartment 520 is defined by two side walls 521, a rear wall 522, a front wall 523, a top wall 524 and a bottom wall 525, the lower compartment 520 essentially supporting the upper compartment 501 as illustrated. The inner surface of the rear wall 522 has two Hall effect sensors 526 thereon for a purpose to be described more fully hereinafter, and there is mounted on the side walls 521 a plurality of supporting rollers 527. The front wall 523 has an opening therein closed by a door 530 hinged as at 531. The door 530 is provided with a lock 532 which can be used to secure the door 530 in the closed position thereof. There further is provided on the inside of the door 530 rollers 535 to assist in moving the cash container 540 from the master vault 500.

The cash container 540 is defined by two side walls 541, a rear wall 42, a front wall 543, a top wall 544 having an opening 545 therein and a bottom wall 546. The rear wall 542 has two permanent magnets 548 mounted thereon for cooperation with the Hall effect sensors 526 described above. Disposed on the rear wall 503 of the upper compartment 501 is a lock mechanism 550 which is essentially identical in construction and operation to the lock mechanism 160 described above in the fare box 100. The lock mechanism 550 serves to lock the cash box 400 within the upper compartment 501 after rotation of the handle 430 to the opening position thereof.

There is provided adjacent to the support 513 a plate 570 that is pivoted in the upper compartment 501 as at 571, the plate 570 essentially underlying the major portion of the cover of an inverted cash box 400 as illustrated in FIG. 23. The plate 570 has depending ears 572 thereon that extend through an opening in the intermediate wall 507 to connect to a dump mechanism generally designated by the numeral 560. The dump mechanism 560 includes a handle 561 exteriorly of the master vault 500 and secured to a shaft 562 journalled within the master vault 500. The shaft 562 carries a collar 563 adjacent to the handle 561 and carries an arm 564 extending radially therefrom (see FIG. 24 also) and connected to a linkage 565 that connects to the ears 571 on the plage 570. Also mounted below the shaft 562 is a solenoid 575 having the usual plunger 576 interconnected by linkage 577, the plunger 576 engaging in a notch in the collar 563 so as fixedly to lock the collar 563 and the connected parts including the shaft 562 and the handle 561 in the lock position and nondumping position thereof. The lower end of the mounting shaft 514 (see FIG. 24) carries an eccentrically arranged downwardly extending extension 516 which engages and drives a latch member 517 disposed in a guide 518, the lefthand end of the latch member 517 being disposed in a notch in the collar 563 to precent actuation of the dump mechanism 560 when the door 510 is in the open position, closure of the door 510 moving the extension 516 to the right in FIG. 24 to withdraw the latch member 517 and thus free the collar 563 and permit subsequent actuation of the dump mechanism 560, provided that the plunger 576 is also withdrawn. After actuation of the dump mechanism 560 by turning of the handle 561, the lefthand end of the latch member 517 rides upon the periphery of the collar 563 so as to prevent opening of the door 510 while the dump mechanism 560 is in the actuated position thereof.

Figure 26:
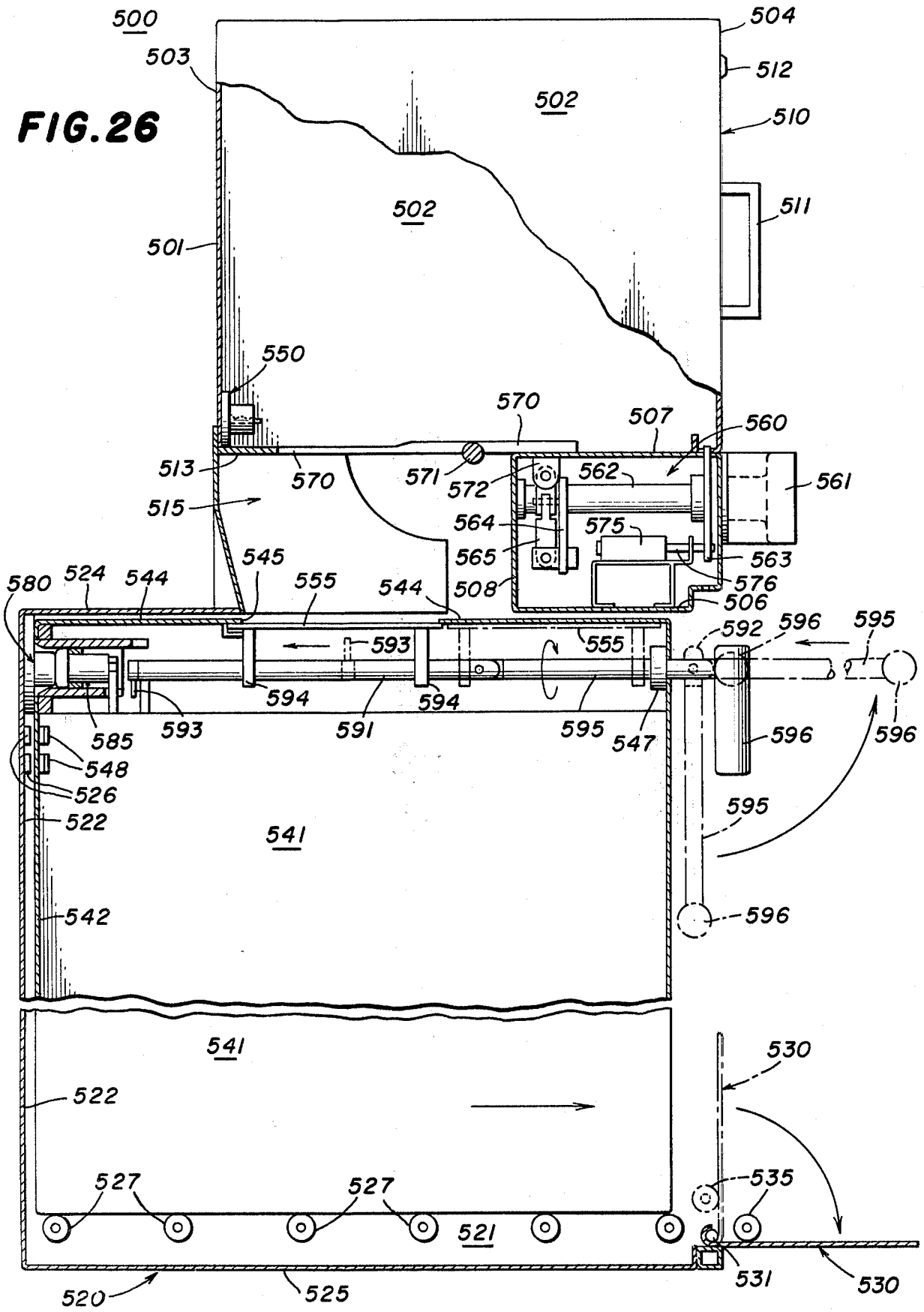
FIG. 26 is a view showing the structure for removing the cash container from the main vault.

Before removing the cash container 540 from the master vault 500, it is necessary for security purposes to close the opening 545 in the top wall 544 and to this end a closure member 555 has been provided. Placement of the closure member 555 in closing relationship to the opening 545, i.e. movement of the closure member 555 from the position illustrated in FIG. 23 to the position illustrated in FIG. 26, is controlled by a handle mechanism 590. The handle mechanism 590 includes a horizontal shaft 591 that is mounted for translating movement in a horizontal direction axially thereof, and to that end is supported by a support 547 mounted on the wall 543. One end of the shaft 591 carries a pivot 592 connecting to a handle 595 and the other end of the shaft 591 carries a lock pin 593. The free end of the handle 595 also carries a gripping portion 596. Mounted on the shaft 591 and fixed longitudinally thereof but rotatably mounted thereon are two arms 594 that support the closure member 555. This mounting permits the closure member 555 to be laterally moved from right to left from the position illustrated in FIG. 23 to the position illustrated in FIG. 26, while accommodating rotation of the shaft 591 about its longitudinal axis. When it is desired to move the closure member 555 to the closing position thereof, the handle 595 is pivoted about the pivot 592 to the horizontal dashed line position of FIG. 26, after which the shaft 591 is shifted laterally and to the left from the position illustrated in FIG. 23 to that illustrated in FIG. 26. This serves to move the closure member 555 to the closing position thereof illustrated in FIG. 26. With the closing member 555 in the closing position thereof, the shaft 591 is rotated using the gripping portion 596 so as to move the formerly upwardly extending pin 593 to the downwrdly extending position of FIG. 26.

There is provided on the rear wall 522 of the lower compartment 520 a lock mechanism 580 like the lock mechanism 160 described above, and there is mounted on the rear wall 542 of the cash container 540 a lock mechanism 585 like the lock mechanism 440 described hereinabove. Upon removal of the cash container 540 from the lower copartment 520, the disengagement of the lock mechanisms 580 and 585 serves to lock the lock mechanism 585 into a position so as to prevent opening movement of the handle mechanism 590 until a key is inserted to release the lock mechanism 585. In order to further assist in withdrawal of the cash container 540 from the master vault 500, an auxiliary handle 557 has been provided on the front wall 543 thereof adjacent to the lower edge thereof.

The following is an explanation of the procedure for transferring the contents of a cash box 400 containing the receipts from a fare box 100 to the coin container 540 in FIGS. 23 to 26. It is assumed that the cash box 400 has coins and/or paper therein in its coin compartment 405 and/or its paper compartment 406, and that the cover 420 is in its fully closed and locked condition. The perator using a key opens the lock 512 and grasping the handle 5 opens the door 510 to the upper compartment 501 of the master vault 500. The cash box 400 is turned upside down with the cover restin upon the plate 570 and the support 513 (see FIGS. 23 and 24 particularly). Such insertion of the cash box 400 into the master vault 500 will cause engagement between the lock mechanism 440 and the lock mechanism 550 which serves to unlock and free the cylinder 450 in the lock mechanism 440. The operator can now turn the handle 430 from the original dashed line position in FIG. 23 to a position 90° with respect thereto, after which the operator can pull the handle 420 to the right to the full position thereof in FIG. 23 and thus to move the cover 420 to the partially open position thereof. It will be noted that the plate 570 essentially blocks the top of the cash box 400 that has been opened, thereby essentially to prevent any of the contents of the cash box 400 from passing downwardly into the chute 515. After moving the handle 430 to the solid line position in FIG. 23, the operator closes the door 510 and acutates the lock 512, closure of the door 510 withdraws the latch member 517 (see FIG. 24), and the sensing of the magnets 548 by the Hall effect sensors 526 serving to energize the solenoid 575 and to withdraw the plunger 576, thus freeing the dumping mechanism 560 which heretofore has been held in the locked position. The now freed dump mechanism 560 can be actuated by the operator grasping the handle 561 and rotating it so as to cause the arm 564 to raise the linkage 565 to pivot the parts in a counterclockwise direction about the pivot 571 from the solid line positions of FIG. 23 to the solid line positions of FIG. 25. This action will open the cash box 400 and permit the contents thereof to be dumped into the chute 515 by which they are conveyed through the opening 545 into the cash container 540. It is noted that during this operation, the cash box 400 is locked within the master fault 500 by the cooperating lock mechanisms 440 and 550 and the master vault is locked by means of the latch member 517 holding the door 510 in the closed position thereof, the dumping mechanism 560 being locked in an inoperative position by the latch member 517 if the door 510 is not in a closed position.

Figure 25:
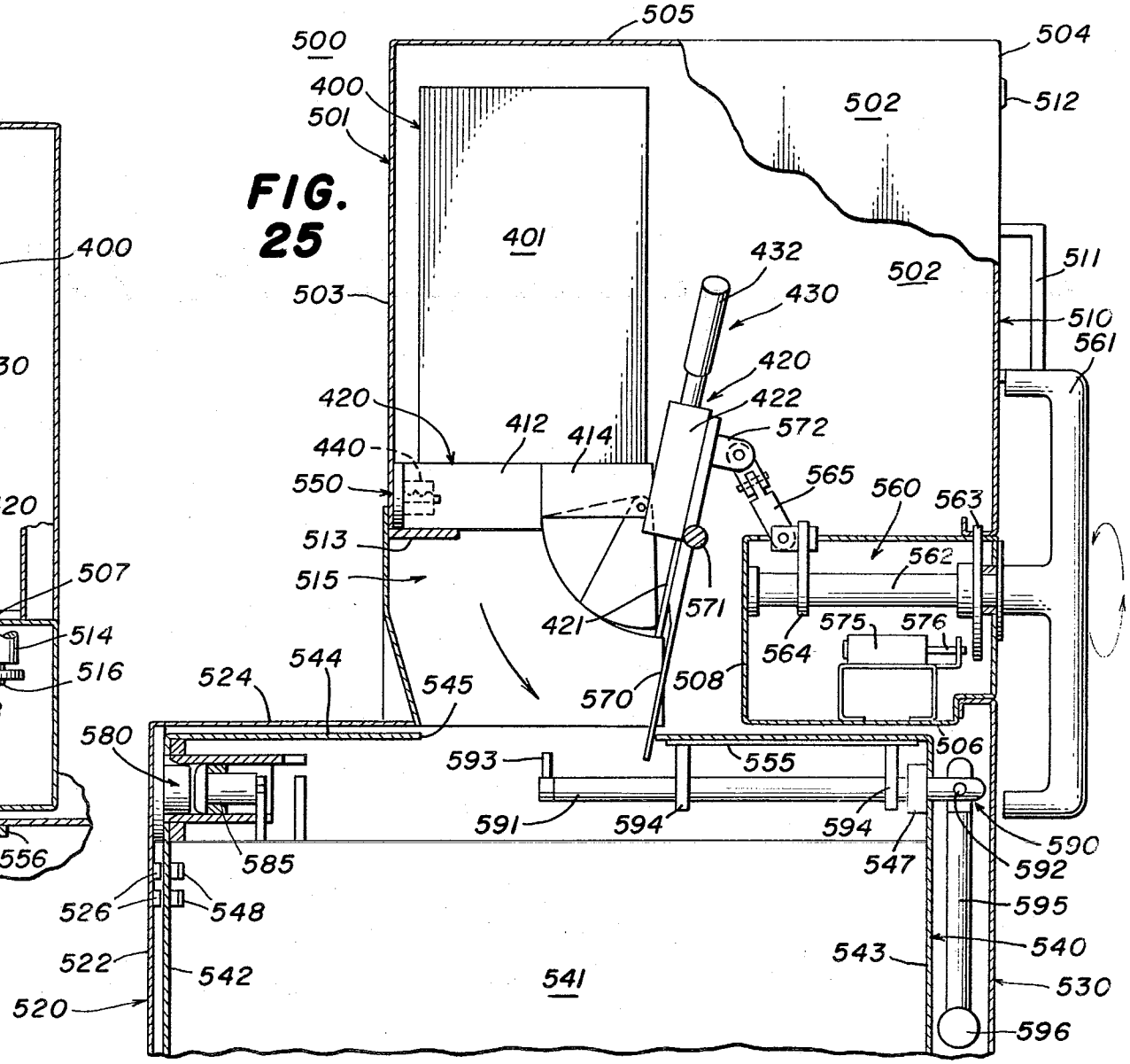
FIG. 25 is a view similar to FIG. 23 but showing the parts in the cash transfer position.
Figure 24:
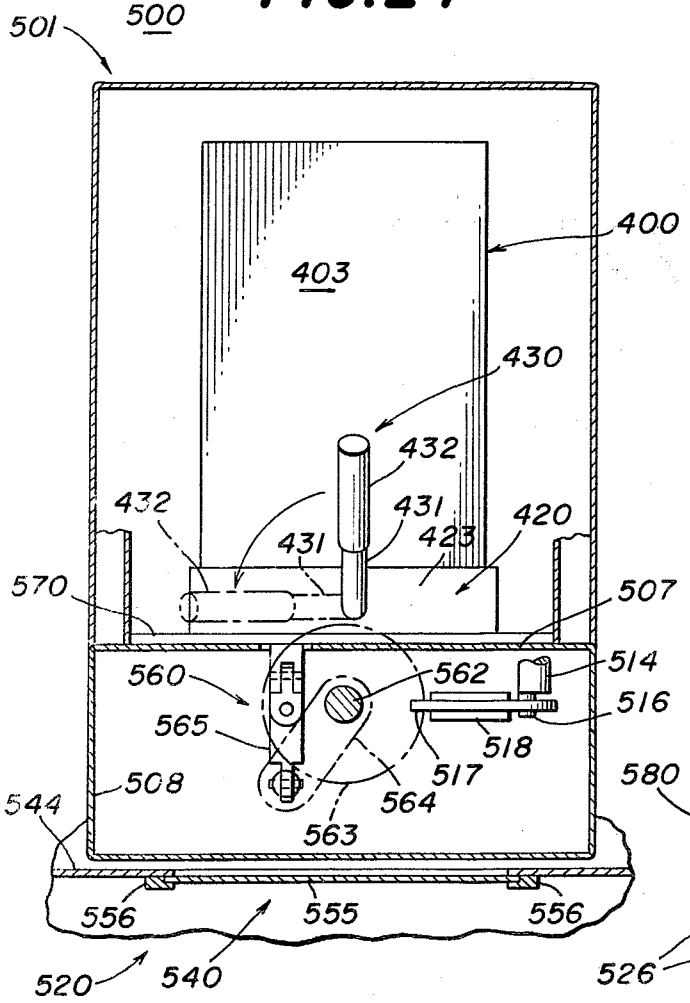
FIG. 24 is a view in vertical section along the line 24—24 of FIG. 23.

The operator after a few seconds turns the handle 561 to reverse the pivoting of the plate 570, i.e., the plate 570 and attached parts are pivoted from the solid line positions in FIG. 25 to the solid line positions in FIG. 23. The operator can now open the door 510, and reclose the cover 420 on the cash box 400 by pushing the cover to the left in FIG. 23 and then moving the handle 430 from the cashed line position in FIG. 24 to the solid line position therein. It will be noted that during this operation, the latch member 517 has been returned to its locking position with respect to the dump mechanism 560, whereby access to the area below the plate 570 is blocked. In other words, there can be no access to the contents of the cash container 540 during the replacement of the cover 420 on the cash box 400 and during the time that the cash box 400 is removed from the upper compartment 501. Replacement of the cover 420 on the cash box 400 and movement of the handle 430 to the solid line position in FIG. 24 disengages the lock mechanisms 440 and 550 thus permitting the withdrawal of the cash box 400 from the master vault 500, this action also simultaneously locking the cover 420 in the closed position on the cash box 400.

When it is desired to remove the cash container 540 from the master vault 500, the operator using a key unlocks the lock 532 which permits the door 530 to be pivoted about a pivot 531 to the lower position illustrated in FIG. 26 in solid lines. The operator then moves the handle 595 from the vertical dashed line position of FIG. 26 to the horizontal dashed line position therein after which the handle is pushed to the left and thereafter turned 180° so as to put the parts in the solid line position of FIG. 26. It will be noted that the pin 593 is now in the locking position and that the closure member 555 closes the opening 545 so as now fully to enclose and lock the cash container 540. The cash container 540 can now be rolled upon the rollers 527 and 535 out of the lower compartment 520 of the master vault 500 and to the right over the door 530. Such movement of the cash container 540 disengages the permanent magnets 548 from the Hall effect sensors 526 and this serves to lock the dump mechanism 560 in the closed non-dumping position illustrated in FIG. 26. The dump mechanism 560 will not again be placed in operative condition until the magnets 548 are in position to be sensed by the Hall effect sensors 526 and the lock 532 is again in the locking position; and even then the dump mechanism 506 cannot be operated until the closing of the door 510 so as to withdraw the latch member 517.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A coin singulating and counting device comprising a mounting plate, a coin sizing disk overlying said mounting plate and mounted for rotation with respect thereto, a transfer plate overlying said sizing disk and fixedly mounted with respect to said mounting plate, a coin singulator disk overlying said transfer plate and mounted for rotation with said sizing disk and with respect to said mounting plate and said transfer plate, means for rotating said singulator disk and said sizing disk with respect to said mounting plate and said transfer plate about an axis inclined to the horizontal, said coin singulator disk having at least one open bottom coin singulating pocket therein for receiving coins one at a time from a supply thereof to travel along a first predetermined path on the upper surface of said transfer plate, said transfer plate having an opening therein along said first path and shaped to receive a coin therethrough off said transfer plate and out of said singulating pocket at a predetermined point along said first path, said coin sizing disk having at least one arcuate open bottom coin sizing pocket therein for receiving coins of various sizes one at a time from said singulating pocket through the opening in said transfer plate to travel along a common second predetermined circular path on the upper surface of said mounting plate, said sizing pocket being elongated circumferentially of said second predetermined path and of increasing size in the direction of travel along said second predetermined path and shaped and arranged to receive a coin at a predetermined position therein in accordance with the size of the coin, said mounting plate having a coin exit opening therein along said second path and shaped to receive a coin therethrough off said mounting plate and out of said sizing pocket at a predetermined point along said second path, and mechanism for measuring the distance along said second path between a predetermined point on said sizing disk and the exit of a coin at said coin exit opening for detecting the size of the coin and for counting the coin as the coin passes into said coin exit opening.

2. The coin singulating and counting device set forth in claim 1, wherein said means for rotating is an electric motor.

3. The coin singulating and counting device set forth in claim 1, wherein said singulating pocket has a trailing edge thinner than the thinnest coin to be handled therein and has a leading edge higher than the thickest coin to be hanled therein.

4. The coin singulating and counting device set forth in claim 1, wherein four of the coin singulating pockets are provided in the signulator disk.

5. The coin singulating and counting device set forth in claim 1, wherein the opening in said transfer plate is arcuate in shape.

6. The coin singulating and counting device set forth in claim 1, wherein said sizing pocket is pear-shaped and receives the smallest coin snugly in the smaller end thereof and receives the largest coin snugly in the largest end thereof.

7. The coin singulating and counting device set forth in claim 1, wherein the number of singulating pockets is equal to the number of sizing pockets.

8. The coin singulating and counting device set forth in claim 1, wherein there are four of the singulating pockets and four of the sizing pockets.

9. The coin singulating and counting device set forth in claim 1, wherein said singulator disk and said sizing disk have the planes of rotation thereof inclined at an angle from about 40° to about 60° with respect to the horizontal.

10. A coin singulating and counting device comprising a mounting plate, a coin sizing disk overlying said mounting plate and mounted for rotation with respect thereto, a transfer plate overlying said sizing disk and fixedly mounted with respect to said mounting plate, a coin singulator disk overlying said transfer plate and mounted for rotation with said sizing disk and with respct to said mounting plate and said transfer plate, means for rotating said singulator disk and said sizing disk with respect to said mounting plate and said transfer plate about an axis inclined to the horizontal, said coin singulator disk having at least one open bottom coin singulating pocket therein for receiving coins one at a time from a supply thereof to travel along a first predetermined path on the upper surface of said transfer plate, said transfer plate having an opening therein along said first path and shaped to receive a coin therethrough off said transfer plate and out of said singulating pocket at a predetermined point along said first path, said coin sizing disk having at least one arcuate open bottom coin sizing pocket thereon for receiving coins of various sizes one at a time from said singulating pocket through the opening in said transfer plate to travel along a common second predetermined circular path on the upper surface of said mounting plate, said sizing pocket being elongated circumferentially of said second predetermined path and of increasing size in the direction of travel along said second predetermined path and shaped and arranged to receive a coin at a predetermined position therein in accodance with the size of the coin, said mounting plate having a coin exit opening therein along said second path and a coin discharge ramp leading into said coin exit opening to receive a coin herealong and then through said coin exit opening off said mounting plate and out of said sizing pocket at a predetermined point along said second path, a coin ejector adjacent to the exit end of said coin discharge ramp to assure that a coin arriving at said coin exit opening exits therethrough off said coin discharge ramp, and mechanism for measuring the distance along said second path between a predetermined point on said sizing disk and the exit end of a coin at the exit end of said coin discharge ramp for detecting the size of the coin and for counting the coin as the coin passes from said coin discharge ramp into said coin exit opening.

11. The coin singulating and counting device set forth in claim 10, wherein said coin exit opening and said coin discharge ramp are arcuate in shape.

12. The coin singulating and counting device set forth in claim 10, wherein the free end of said ejector overlies the exit end of said coin discharge ramp.

13. The coin singulating and counting device set forth in claim 10, and further comprising coin guiding surfaces extending from said transfer plate downwardly toward said coin exit ramp to insure that coins in said sizing pockets are moved downwardly along said coin exit ramp and under said ejector.

14. A coin singulating and counting device comprising a mounting plate, a coin sizing disk overlying said mounting plate and mounted for rotation with respect thereto, a transfer plate overlying said sizing disk and fixedly mounted with respect to said mounting plate, a coin singulator disk overlying said transfer plate and mounted for rotation with said sizing disk and with respect to said mounting plate and said transfer plate, means for rotating said singulator disk and said sizing disk with respect to said mounting plate and said transfer plate about an axis inclined to the horizontal, said coin singulator disk having at least one open bottom coin singulating pocket therein for receiving coins one at a time from a supply thereof to travel along a first predetermined path on the upper surface of said transfer plate, said transfer plate having an opening therein along said first path and shaped to receive a coin therethrough off said transfer plate and out of said singulating pocket at a predetermined point along said first path, said coin sizing disk having at least one open bottom coin sizing pocket therein for receiving coins one at a time from said singulating pocket through the opening in said transfer plate to travel along a second predetermined path on the upper surface of said mounting plate, said sizing pocket being of increasing size in the direction of travel and shaped and arranged to receive a coin at a predetermined position therein in accordance with the size of the coin, said mounting plate having a coin exit opening therein along said second path and shaped to receive a coin therethrough off said mounting plate and out of said sizing pocket at a predetermined point along said second path, timing indicia associated with said sizing pocket and indicia sensing means mounted adjacent to said sizing disk for detecting the passage of said timing indicia thereby, a detector for detecting the leading edge of a coin at a predetermined point along said second path, and timing mechanism initiated by the sensing of said timing indicia and terminated by the actuation of said detector for measuring the distance between a predetermined point along said second path and the exit end of a coin at said coin exit opening for detecting the size of the coin and for counting the coin as the coin passes into said coin exit opening.

15. The coin singulating and counting device set forth in claim 14, wherein said timing indicia is an opening in said coin sizing disk and said indicia sensing means is a proximity sensor mounted adjacent to the path of movement of said opening.

16. The coin singulating and counting device set forth in claim 14, wherein said detector is a microswitch having an actuator positioned to be contacted by the leading edge of a coin entering said coin exit opening.

17. A coin singulating and counting device comprising a mounting plate, a coin sizing disk overlying said mounting plate and mounted for rotation with respect thereto, a transfer plate overlying said sizing disk and fixedly mounted with respect to said mounting plate, a coin singulator disk overlying said transfer plate and mounted for rotation with said sizing disk and with respect to said mounting plate and said transfer plate, means for rotating said singulator disk and said sizing disk with respect to said mounting plate and said transfer plate about an axis inclined to the horizontal, said coin singulator disk having at least one open bottom coin singulating pocket therein for receiving coins one at a time from a supply thereof to travel along a first predetermined path on the upper surface of said transfer plate, said transfer plate having an opening therein along said first path and shaped to receive a coin therethrough off said transfer plate and out of said singulating pocket at a predetermined point along said first path, said coin sizing disk having at least one open bottom coin sizing pocket thereon for receiving coins one at a time from said singulating pocket through the opening in said transfer plate to travel along a second predetermmined path on the upper surface of said mounting plate, said sizing pocket being of increasing size in the direction of travel and shaped and arranged to receive a coin at a predetermined position therein in accodance with the size of the coin, said mounting plate having a coin exit opening therein along said second path and a coin discharge ramp leading into said coin exit opening to receive a coin therealong and then through said coin exit opening off said mounting plate and out of said sizing pocket at a predetermined point along said second path, a coin ejector adjacent to the exit end of said coin discharge ramp to assure that a coin arriving at said coin exit opening exits therethrough off said coin discharge ramp, timing indicia associated with said sizing pocket and indicia sensing means mounted adjacent to said sizing disk for detecting the passage of said timing indicia thereby, a detector for detecting the leading edge of a coin at the exit end of said coin discharge ramp, and timing mechanism initiated by the sensing of said timing indicia and terminated by the actuation of said detector for measuring the distance between a predetermmined point along said second path and the exit end of said coin at the exit end of said coin discharge ramp for detecting the size of the coin and for counting the coin as the coin passes from said exit ramp into said coin exit opening.

18. The coin singulating and counting device set forth in claim 17, wherein said detector is a microswitch having an actuator positioned to be contacted by the leading edge of a coin entering said coin exit opening.

19. The coin singulating and counting device set forth in claim 17, wherein said detector is a microswitch having an actuating arm positioned at the exit end of said coin discharge ramp for detecting the leading edge of a coin as it exits from the coin discharge ramp into said coin exit opening.

* * * * *